United States Patent [19]

Christiansen

[11] 3,940,951

[45] Mar. 2, 1976

[54] KNITTING MACHINE CONTROL

[75] Inventor: Paul Christiansen, Novelty, Ohio

[73] Assignee: Hayes-Albion Corporation, Norristown, Pa.

[22] Filed: Oct. 27, 1971

[21] Appl. No.: 193,047

[52] U.S. Cl. ..... 66/50 R; 66/155; 340/172.5

[51] Int. Cl.[2] ..... D04B 15/78

[58] Field of Search .... 66/50 R, 154 A, 50 A, 50 B, 66/25; 340/174.1 C, 174.1 J, 174.1 K, 172.5; 235/151.1

[56] References Cited

UNITED STATES PATENTS

| | | | |
|---|---|---|---|
| 2,892,183 | 6/1959 | Selmer | 340/172.5 |
| 3,016,522 | 1/1962 | Lourie et al. | 340/174.1 C |
| 3,232,079 | 2/1966 | Levine et al. | 66/154 A |
| 3,446,037 | 5/1969 | Sutton | 66/25 |
| 3,601,808 | 8/1971 | Vlack | 340/172.5 |
| 3,623,039 | 11/1971 | Barham | 340/174.1 J |
| 3,662,348 | 5/1972 | Weiss | 340/172.5 |
| 3,709,002 | 1/1973 | Brandt et al. | 66/50 R X |
| 3,844,139 | 10/1974 | De Cerjat | 66/50 R |

FOREIGN PATENTS OR APPLICATIONS

| | | | |
|---|---|---|---|
| 2,004,194 | 9/1970 | Germany | 235/151.1 |
| 1,273,661 | 5/1972 | United Kingdom | 66/50 R |
| 1,474,081 | 2/1967 | France | 66/50 R |
| 1,522,413 | 3/1968 | France | 66/50 R |
| 1,194,731 | 6/1970 | United Kingdom | 66/25 |
| 1,800,794 | 8/1970 | Germany | 66/50 R |

*Primary Examiner*—Wm. Carter Reynolds

[57] ABSTRACT

A control for a circular knitting machine having a magnetic disc memory for storing data descriptive of a pattern to be knitted, position indicating means for indicating the rotational position of the knitting machine, electronic circuitry for retrieving segments of data from the magnetic disc memory as needed, and electromagnetic actuators for steering the knitting meedles to knit or non-knit positions in accordance with the retrieved data.

12 Claims, 13 Drawing Figures

| | 2 FEEDERS PER STITCH ROW | | | 3 FEEDERS PER STITCH ROW | | | | 4 FEEDERS PER STITCH ROW | | | |
|---|---|---|---|---|---|---|---|---|---|---|---|
| | FEEDER GROUP | 2-COLOR PLAIN | 1-COLOR TUCK | FEEDER GROUP | 3-COLOR PLAIN | 2-COLOR BLISTER | 1-COLOR BLISTER | FEEDER GROUP | 4 COLOR PLAIN | 3-COLOR BLISTER | |
| F0 | 1 | A | A | 1 | A | A | A | 1 | A | A | F0 |
| F1 | | B | A | | B | B | A | | B | C | F1 |
| F2 | 2 | A | A | | C | B | A | | C | B | F2 |
| F3 | | B | A | 2 | A | A | A | | D | C | F3 |
| F4 | 3 | A | A | | B | B | A | 2 | A | A | F4 |
| F5 | | B | A | | C | B | A | | B | C | F5 |
| F6 | 4 | A | A | 3 | A | A | A | | C | B | F6 |
| F7 | | B | A | | B | B | A | | D | C | F7 |
| F8 | 5 | A | A | | C | B | A | 3 | A | A | F8 |
| F9 | | B | A | 4 | A | A | A | | B | C | F9 |
| F10 | 6 | A | A | | B | B | A | | C | B | F10 |
| F11 | | B | A | | C | B | A | | D | C | F11 |
| F12 | 7 | A | A | 5 | A | A | A | 4 | A | A | F12 |
| F13 | | B | A | | B | B | A | | B | C | F13 |
| F14 | 8 | A | A | | C | B | A | | C | B | F14 |
| F15 | | B | A | 6 | A | A | A | | D | C | F15 |
| F16 | 9 | A | A | | B | B | A | 5 | A | A | F16 |
| F17 | | B | A | | C | B | A | | B | C | F17 |
| F18 | 10 | A | A | 7 | A | A | A | | C | B | F18 |
| F19 | | B | A | | B | B | A | | D | C | F19 |
| F20 | 11 | A | A | | C | B | A | 6 | A | A | F20 |
| F21 | | B | A | 8 | A | A | A | | B | C | F21 |
| F22 | 12 | A | A | | B | B | A | | C | B | F22 |
| F23 | | B | A | | C | B | A | | D | C | F23 |
| F24 | 13 | A | A | 9 | A | A | A | 7 | A | A | F24 |
| F25 | | B | A | | B | B | A | | B | C | F25 |
| F26 | 14 | A | A | | C | B | A | | C | B | F26 |
| F27 | | B | A | 10 | A | A | A | | D | C | F27 |
| F28 | 15 | A | A | | B | B | A | 8 | A | A | F28 |
| F29 | | B | A | | C | B | A | | B | C | F29 |
| F30 | 16 | A | A | 11 | A | A | A | | C | B | F30 |
| F31 | | B | A | | B | B | A | | D | C | F31 |
| F32 | 17 | A | A | | C | B | A | 9 | A | A | F32 |
| F33 | | B | A | 12 | A | A | A | | B | C | F33 |
| F34 | 18 | A | A | | B | B | A | | C | B | F34 |
| F35 | | B | A | | C | B | A | | D | C | F35 |

FIG. 3

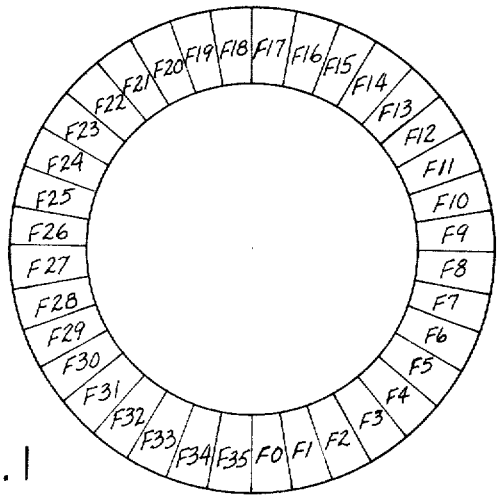

FIG. 1

| | REVOLUTIONS | | | | | | |
|---|---|---|---|---|---|---|---|
| | 12 | 13 | 14 | 15 | 16 | 17 |
| F0 | 109 | 118 | 127 | 136 | 145 | 154 |
| F1 | 109 | 118 | 127 | 136 | 145 | 154 |
| F2 | 109 | 118 | 127 | 136 | 145 | 154 |
| F3 | 109 | 118 | 127 | 136 | 145 | 154 |
| F4 | 110 | 119 | 128 | 137 | 146 | 155 |
| F5 | 110 | 119 | 128 | 137 | 146 | 155 |
| F6 | 110 | 119 | 128 | 137 | 146 | 155 |
| F7 | 110 | 119 | 128 | 137 | 146 | 155 |
| F8 | 111 | 120 | 129 | 138 | 147 | 156 |
| F9 | 111 | 120 | 129 | 138 | 147 | 156 |
| F10 | 111 | 120 | 129 | 138 | 147 | 156 |
| F11 | 111 | 120 | 129 | 138 | 147 | 156 |
| F12 | 112 | 121 | 130 | 139 | 148 | 157 |
| F13 | 112 | 121 | 130 | 139 | 148 | 157 |
| F14 | 112 | 121 | 130 | 139 | 148 | 157 |
| F15 | 112 | 121 | 130 | 139 | 148 | 157 |
| F16 | 113 | 122 | 131 | 140 | 149 | 158 |
| F17 | 113 | 122 | 131 | 140 | 149 | 158 |
| F18 | 113 | 122 | 131 | 140 | 149 | 158 |
| F19 | 113 | 122 | 131 | 140 | 149 | 158 |
| F20 | 114 | 123 | 132 | 141 | 150 | 159 |
| F21 | 114 | 123 | 132 | 141 | 150 | 159 |
| F22 | 114 | 123 | 132 | 141 | 150 | 159 |
| F23 | 114 | 123 | 132 | 141 | 150 | 159 |
| F24 | 115 | 124 | 133 | 142 | 151 | 160 |
| F25 | 115 | 124 | 133 | 142 | 151 | 160 |
| F26 | 115 | 124 | 133 | 142 | 151 | 160 |
| F27 | 115 | 124 | 133 | 142 | 151 | 160 |
| F28 | 116 | 125 | 134 | 143 | 152 | 161 |
| F29 | 116 | 125 | 134 | 143 | 152 | 161 |
| F30 | 116 | 125 | 134 | 143 | 152 | 161 |
| F31 | 116 | 125 | 134 | 143 | 152 | 161 |
| F32 | 117 | 126 | 135 | 144 | 153 | 162 |
| F33 | 117 | 126 | 135 | 144 | 153 | 162 |
| F34 | 117 | 126 | 135 | 144 | 153 | 162 |
| F35 | 117 | 126 | 135 | 144 | 153 | 162 |

FIG. 4C

| | REVOLUTIONS | | | | | |
|---|---|---|---|---|---|---|
| | 18 | 19 | 20 | 21 | 22 | 23 |
| F0 | 163 | 172 | 181 | 190 | 199 | 208 |
| F1 | 163 | 172 | 181 | 190 | 199 | 208 |
| F2 | 163 | 172 | 181 | 190 | 199 | 208 |
| F3 | 163 | 172 | 181 | 190 | 199 | 208 |
| F4 | 164 | 173 | 182 | 191 | 200 | 209 |
| F5 | 164 | 173 | 182 | 191 | 200 | 209 |
| F6 | 164 | 173 | 182 | 191 | 200 | 209 |
| F7 | 164 | 173 | 182 | 191 | 200 | 209 |
| F8 | 165 | 174 | 183 | 192 | 201 | 210 |
| F9 | 165 | 174 | 183 | 192 | 201 | 210 |
| F10 | 165 | 174 | 183 | 192 | 201 | 210 |
| F11 | 165 | 174 | 183 | 192 | 201 | 210 |
| F12 | 166 | 175 | 184 | 193 | 202 | 211 |
| F13 | 166 | 175 | 184 | 193 | 202 | 211 |
| F14 | 166 | 175 | 184 | 193 | 202 | 211 |
| F15 | 166 | 175 | 184 | 193 | 202 | 211 |
| F16 | 167 | 176 | 185 | 194 | 203 | 212 |
| F17 | 167 | 176 | 185 | 194 | 203 | 212 |
| F18 | 167 | 176 | 185 | 194 | 203 | 212 |
| F19 | 167 | 176 | 185 | 194 | 203 | 212 |
| F20 | 168 | 177 | 186 | 195 | 204 | 213 |
| F21 | 168 | 177 | 186 | 195 | 204 | 213 |
| F22 | 168 | 177 | 186 | 195 | 204 | 213 |
| F23 | 168 | 177 | 186 | 195 | 204 | 213 |
| F24 | 169 | 178 | 187 | 196 | 205 | 214 |
| F25 | 169 | 178 | 187 | 196 | 205 | 214 |
| F26 | 169 | 178 | 187 | 196 | 205 | 214 |
| F27 | 169 | 178 | 187 | 196 | 205 | 214 |
| F28 | 170 | 179 | 188 | 197 | 206 | 215 |
| F29 | 170 | 179 | 188 | 197 | 206 | 215 |
| F30 | 170 | 179 | 188 | 197 | 206 | 215 |
| F31 | 170 | 179 | 188 | 197 | 206 | 215 |
| F32 | 171 | 180 | 189 | 198 | 207 | 216 |
| F33 | 171 | 180 | 189 | 198 | 207 | 216 |
| F34 | 171 | 180 | 189 | 198 | 207 | 216 |
| F35 | 171 | 180 | 189 | 198 | 207 | 216 |

FIG. 4D

KNITTING MACHINE CONTROL

BACKGROUND OF THE INVENTION

The field of the invention is generally knitting machines, and more particularly, pattern controls for circular knitting machines. Circular knitting machines are well-known and have been built for many years. A number of pattern control devices for circular knitting machines are also well known, the most common at the present being of the Jacquard type having a plurality of pattern drums, discs, or belts. One known variation utilizes a photographic film for recording the knitting commands.

Each of the presently known knitting machine controls has a number of disadvantages. For example, a pattern drum control employs a pattern drum at each feeder of the knitting machine. Each pattern drum may have as many as 600 pin locations. In a 32-feeder circular knitting machine, there would be 19,200 pin locations, three-fourths of which could require a pin for knitting a four-color pattern. Setting pins in a particular drum is a tedious and exacting task. Although devices have been built that aid in setting the pins, the task is at best very time consuming and subject to human error.

The present invention contemplates the use of rotating magnetic drum or disc memory for storing pattern data. Other forms of memory, such as magnetic core, may also be used. However, rotating magnetic memory is generally more economical in the storage capacity range required, and suitable buffering enables it to be used for the present application. A magnetic disc memory is currently preferred.

One of the advantages of using computer-type memory, such as magnetic disc memory, for storing pattern data is that the plurality of mechanical drives for synchronizing pattern drum movements with the knitting machine are eliminated. Synchronism in the present control is provided by a single encoder or pulse generator that provides the necessary data address signals to the data retrieval circuitry and synchronizing signals to the actuator driver circuitry at each feeder.

Another advantage of the present control is the ease with which patterns can be changed. It is necessary only to read a new set of data into the magnetic disc memory, or if desired, plug a different disc memory into the data retrieval circuitry. Also the particular data address format used relates the memory address of each bit of data to the stitch row and stitch of the pattern it defines. This facilitates alteration of patterns.

Still another advantage of the present control is its repetitive use of knitting data within a pattern cycle. For example, in a 36-feeder knitting machine knitting a four-color plain fabric pattern, 24 revolutions of the knitting machine are required to knit a complete 208 stitch by 216 stitch row pattern. To make full use of the machine, however, the pattern is knitted nine times around the circumference of the knitted tube during these 24 revolutions. In a known control using a photographic film to store pattern data, it would be necessary to store the pattern information nine times to take full advantage of the knitting machine capability. This is not necessary in the control of the present invention, wherein the pattern information need be stored only once, thereby greatly reducing the amount of memory required.

It is therefore an object of the present invention to provide an improved knitting machine control.

It is a further object to provide a knitting machine control wherein knitting pattern data is stored in computer type memory and the pattern data is re-used a number of times within a pattern cycle.

It is still another object of the present invention to provide a control as above wherein the memory addresses of pattern data are easily related to pattern stitch rows and stitches defined by the data stored therein.

These and other objects of the invention will become more apparent from the following detailed description of a presently-preferred embodiment, which is shown in the accompanying drawings.

FIG. 1 is a diagram showing the location of the feeders around a 36-feeder circular knitting machine.

FIG. 3 is a table illustrating some of the ways the illustrative knitting machine may be threaded to knit some representative patterns.

FIG. 4A-4D is a diagrammatic table showing the stitch rows knitted by each feeder of the illustrative knitting machine during the knitting of a 208-stitch by 216-stitch row four-color plain pattern.

Figure 2:
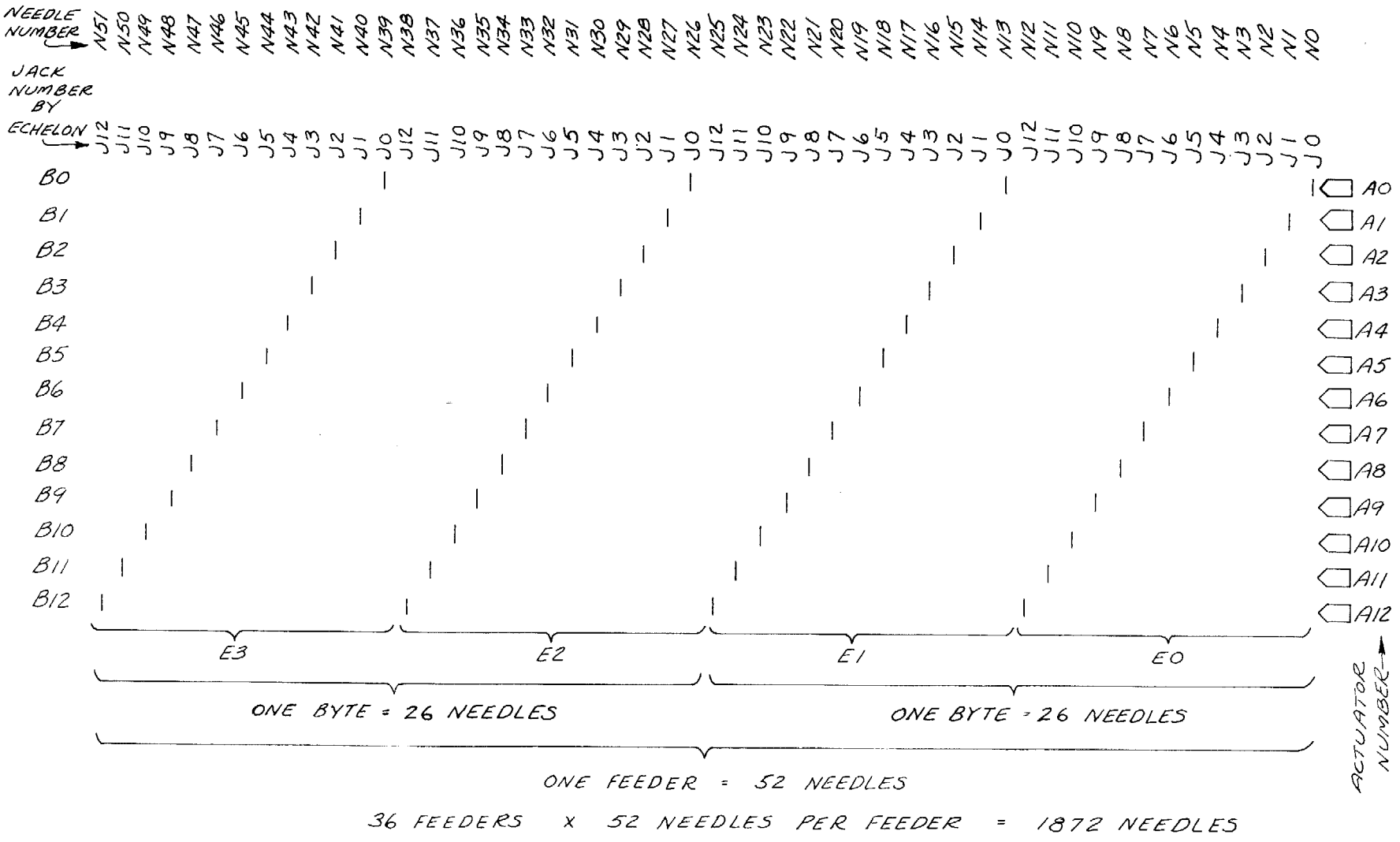
FIG. 2 is a schematic diagram showing the relative positions of the selector butts on a plurality of selector jacks and the actuators at a feeder.
Figure 4A:
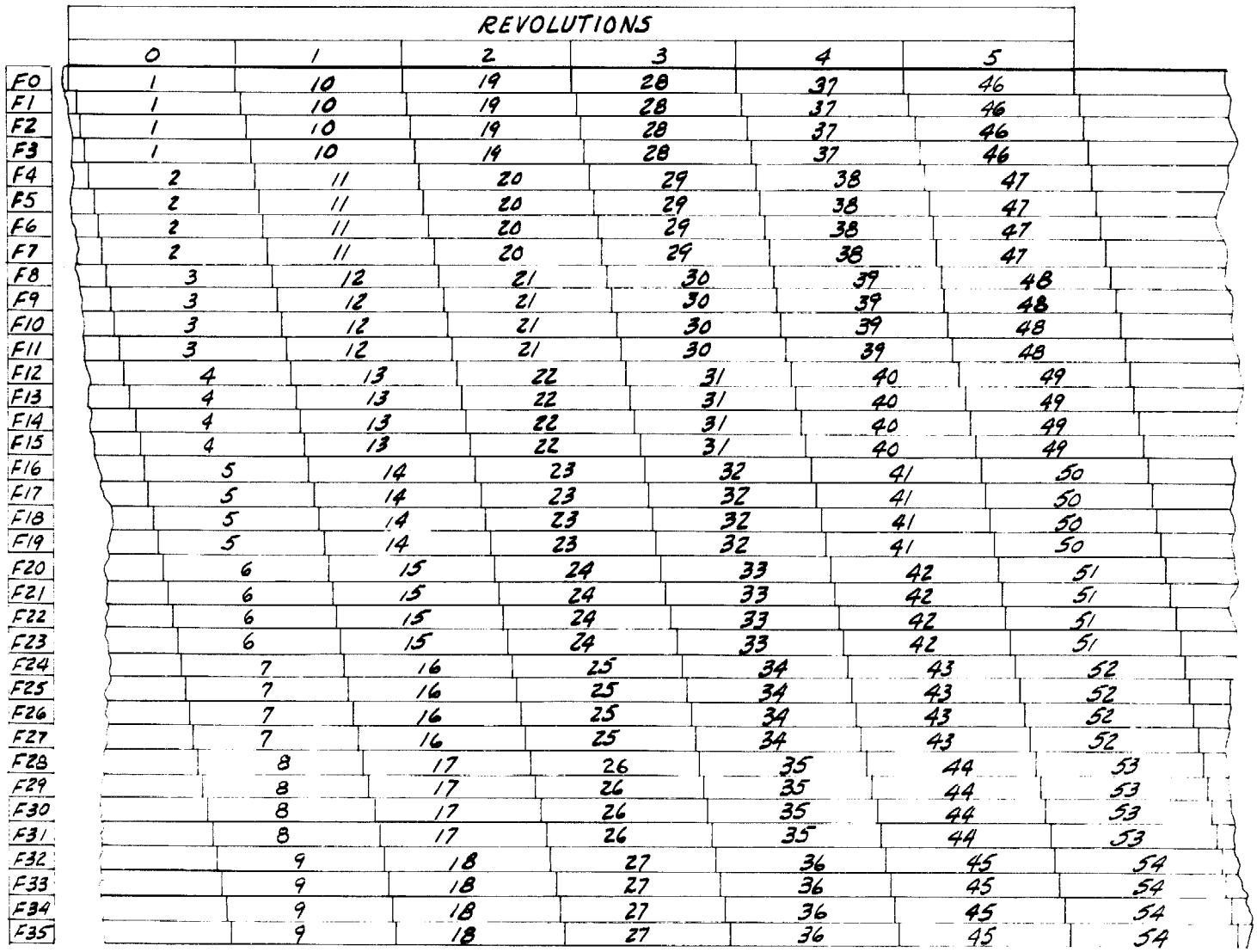
Figure 4B:
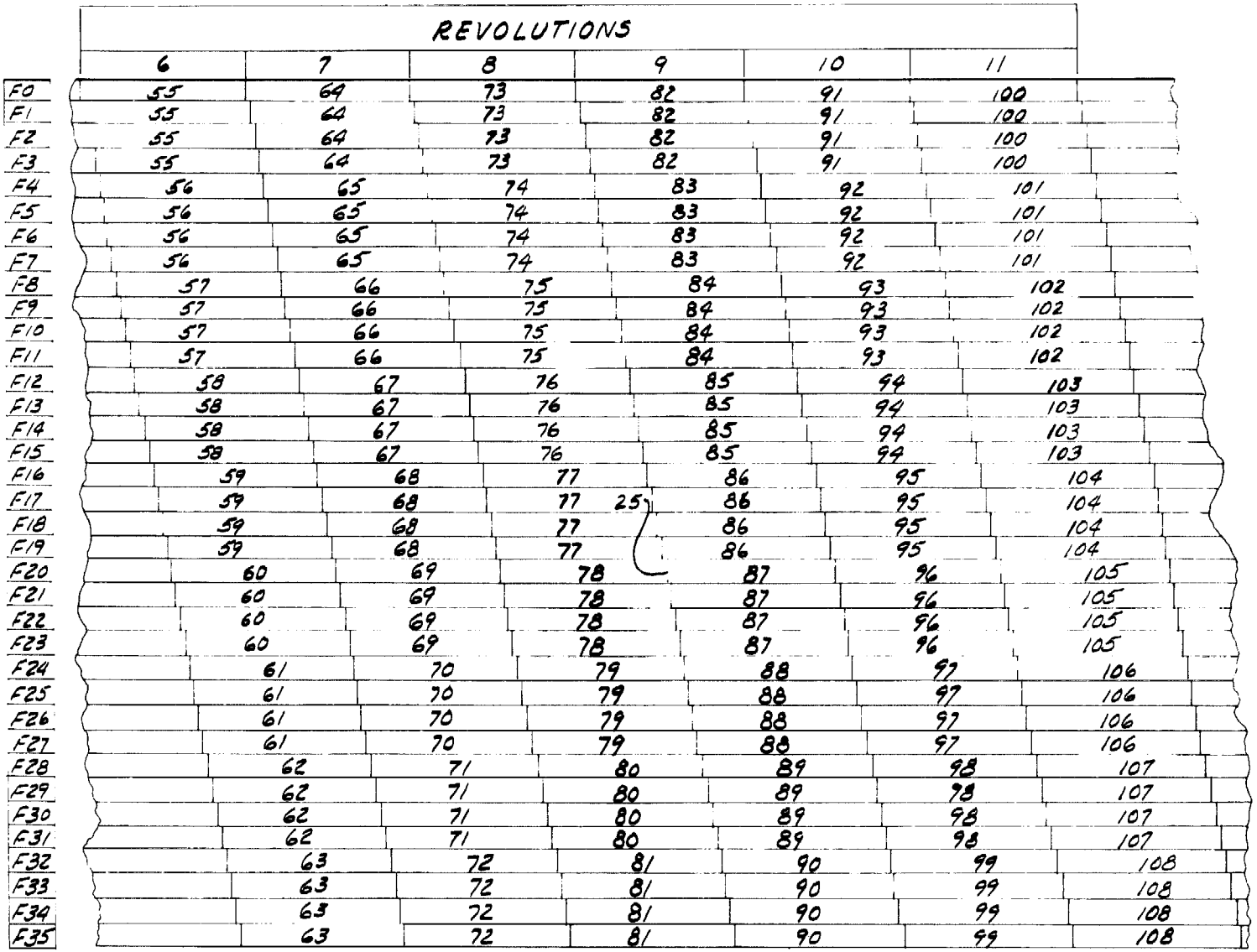

The particular knitting machine that will be used for illustration throughout this specification is a 36-feeder circular knitting machine having 1,872 knitting needles in its cylinder and dial. As shown schematically in FIG. 1, the feeders are arranged around the circumference of the knitting frame and are identified by the reference characters F0-F35. Individual needles will be referred to by the reference characters N0-N1871.

In the well-known variations of Jacquard pattern mechanisms, such as those employing pattern drums having a plurality of actuating pins located therein defining the pattern to be knitted, the actuating pins operate to rock selector jacks so that a cam butt on each selector jack enters one of two cam tracks, generally referred to as the knit and non-knit cam tracks. Whether the needle associated with a selector jack that is rocked so that its cam butt engages the knit cam track is raised to the knit or tuck position is determined by a manual setting of a needle jack cam track to either the knit height or the tuck height. Thus, depending upon the manual setting of the needle jack cam track at a given feeder, a needle will either knit or tuck when the cam butt of its associated selector jack engages the knit cam track. Hereafter, when reference is made to selecting a needle to knit, it will be understood that this may also refer to the tuck position. The non-knit position may also occasionally be referred to as the welt position.

In the illustrative embodiment of the present invention, the selector butts of the selector jacks are arranged in echelon formation of thirteen butts per echelon. Of course, there is a group of thirteen needles associated with each echelon of selector jacks. This number (13) can be varied in accordance with the requirements of different knitting machines. The selector jack arrangement is illustrated in FIG. 2 which shows four echelons, E0-E3, of selector jacks, J0-J12. Each selector jack J0-J12 has a respective selector butt B0-B12.

Thirteen electromagnetic actuators A0-A12 at each feeder, one aligned with each selector butt position, are selectively energized to interfere, or not interfere, respectively, with the selector butts. Interference by an actuator with a selector butt will rock the selector jack to cause its cam butt to enter the non-knit cam track to cause the associated needle to non-knit. Non-interference will permit the cam butt to enter the knit cam track. It will be recognized by those skilled in the art that this selection process could readily be reversed. That is, a knitting machine could be designed wherein interference would cause the cam butt to enter the knit cam track and non-interference would permit the cam butt to enter the non-knit cam track.

As viewed in FIG. 2, the selector jacks move rightward while the actuators remain fixed. In this manner, the jacks J0-J12 of the first echelon E0 are successively brought into position for possible interference between their selector butts and associated actuators. Following echelon E0 are echelons E1, E2, and E3 each having jacks J0-J12. Each electromagnetic actuator A0-A12 is associated with only one selector butt position, and therefore is associated with only one needle in each echelon. This requires each actuator to steer only every thirteenth needle, allowing time after each operation for the actuator to be positioned in advance of the arrival of the next jack it is to steer.

It should be noted that the control of the present invention may also be used to control a knitting machine having a single actuator at each feeder, wherein there is no echelon formation and the single actuator steers every needle. For such an application the actuator enable signals to be described below would not be required, but the remainder of the control would be the same.

To enable each actuator to be energized or de-energized at the proper time, an optical shaft encoder or pulse generator may be used. The presently preferred embodiment uses an optical shaft encoder that is described in application Ser. No. 192,984 filed Oct. 27, 1971 by Ralph H. Schuman now U.S. Pat. No. 3,831,402 and entitled Knitting Machine Encoder and assigned to the assignee of the present application. The encoder is geared to the cylinder of the knitting machine and provides a unique combination of binary coded numbers for each advance of the cylinder by one needle position. These binary coded numbers will be referred to herein as the actuator count number, the byte count number, the feeder count number, and the revolution count number. Of these binary coded numbers, we need now consider only the actuator count number. The actuator count proceeds repetitively from 0 – 12 (13 counts) as the machine cylinder rotates. By decoding the binary coded actuator count to provide 13 individual signals, one actuator at each feeder is enabled by each of the thirteen discrete actuator count numbers generated by the encoder. Properly orienting the encoder disc with respect to the knitting machine cylinder assures that the actuators at each feeder will be serially enabled as their associated selector jacks move into their respective positions for possible interference by the actuators. Since other encoders could be utilized if desired and to avoid undue prolixity of description, the encoder will not be described in detail herein and the disclosure of the above indentified Schuman application should be considered as being incorporated herein in its entirety by this reference thereto.

The illustrative knitting machine may be set up to knit a variety of types of patterns. For example, the illustrative machine may be set up to knit two-color plain, one-color tuck, three-color plain, one color blister, two-color blister, four-color plain, and three-color blister patterns. The first two types require two feeders per stitch row, the second three types require three feeders per stitch row, and the last two types require four feeders per stitch row. This is illustrated in FIG. 3 where it can be seen that to knit a two-color plain pattern the even numbered feeders are threaded with yarn of color A and the odd numbered feeders are threaded with yarn of color B. Letting a feeder group consist of the number of feeders required to knit one stitch row of a pattern, it will be seen from FIG. 3 that the illustrative machine when knitting a two-color plain pattern will have its 36 feeders operated in 18 feeder groups of two feeders each. Similarly, if three feeders are required to knit a stitch row of the pattern, there will be twelve feeder groups of three feeders each. Likewise, if four feeders are required to knit one stitch row of the pattern, there will be nine feeder groups of four feeders each.

By way of illustration, the knitting machine set-up and operation required to knit a four-color plain pattern will now be described. The knitting machine is set up as shown in FIG. 3 for four-color plain patterns, with yarn of color A at feeder F0, yarn of color B at feeder F1, yarn of color C at feeder F2, and yarn of color D at feeder F3. This A, B, C, D sequence of yarn colors is repeated for the remaining feeders. Thus, feeders F0, F1, F2, and F3 comprise feeder group 1; feeders F4, F5, F6 and F7 comprise feeder group 2; feeders F8, F9, F10, and F11 comprise feeder group 3; etc. For a four-color plain pattern, each needle will knit only once in each feeder group, and therefore, will knit nine times during each full revolution of the cylinder. Thus, if a stitch of stitch row 1 of the pattern is knitted in the first feeder group (F0-F3) by a given needle, that needle will knit a stitch of stitch row 2 of the pattern in the second group (F4-F7) and so on, knitting a stitch of stitch row 9 in the ninth feeder group (F32-F35). After one full revolution, when the given needle is ready to re-enter the first feeder group (F0-F3) it is ready to knit a stitch of stitch row 10 of the pattern. Therefore, it will be seen that the first feeder group will knit stitch row 1 of the pattern for one full revolution, and then begin knitting stitch row 10 of the pattern. Because of the geometry of the knitting machine and the arbitrary pattern size chosen (208 stitches wide by 216 stitch rows high), nine repeats of the pattern will be knitted around the circumference. This is due to the fact that the pattern is 208 stitches wide and there are 1872 stitches in each stitch row. Thus, the first feeder group will knit stitch row 1 of the pattern nine times during the full revolution mentioned above before starting to knit stitch row 10 of the pattern. Stitch row 10, of course, will be knitted nine times during the second full revolution of the needle cylinder by the first feeder group (F0-F3).

The four feeders of a feeder group cannot simultaneously change over from knitting stitch row 1 of the pattern to knitting stitch row 10 of the pattern. The change must take place feeder by feeder, even within the feeder groups. Therefore, in the illustrative example of a four-color plain pattern 208 stitches wide by 216 stitch rows high, feeder F0 will knit stitch row 1 for the first full revolution of the knitting machine before changing to stitch row 10. Feeder F1, however, will initially be knitting stitch row 208. Feeder F1 will not begin knitting stitch row 1 until 52 needles after feeder F0 begins knitting stitch row 1, but feeder F1 will continue to knit stitch row 1 for 52 needles after feeder FO changes over to stitch row 10.

The point upon the knitting cylinder between the last needle to knit a stitch of stitch row 1 and the first needle to knit a stitch of stitch row 10 is called the change point. On pattern drum machines, the change point is a fixed location on the knitting cylinder where a single cog is located. Each time the cog enters a feeder, it engages a pattern drum advancing mechanism and advances the pattern drum by one pin row, bringing the next row of pins into operative relationship with the selector butts. To provide clearance for pattern drum rotation, a number of needles and their associated jacks are left out of the cylinder near the change point. This causes a discontinuity in the knitted pattern several stitches wide.

With the control of the present invention, no needles need be left out of the cylinder, and the change point may be located to be between any two adjacent needles. The location of the change point is determined by the orientation of the encoder with respect to the cylinder.

For convenience of illustration, assume that the change point lies between needles N1871 and N0, that needle N0 is just ready to enter feeder F0, and that feeder F0 is just ready to start knitting stitch row 1 of the pattern. Feeders F1, F2, and F3 will be knitting stitch row 208 of the pattern. When the cylinder has moved one feeder distance (52 needles) the change point reaches feeder F1 and feeder F1 changes from knitting stitch row 208 to knitting stitch row 1 of the pattern while feeders F2 and F3 continue knitting stitch row 208. After another feeder distance, the change point is entering feeder F2 and feeder F2 changes from stitch row 208 to stitch row 1. Likewise, still another feeder distance later, feeder F3 changes from knitting stitch row 208 to knitting stitch row 1.

Needle N0 has now moved 208 needle positions, or in other words, has moved through four feeders and is ready to enter feeder F4, which is the first feeder of feeder group 2. In a four-color plain pattern of the example, needle N0 has knitted one stitch during its passage through feeders F0-F3. The next time needle N0 knits, the stitch knitted will be in pattern stitch row 2. Therefore, feeder F4 must change to knitting pattern stitch row 2 just before needle N0 enters it. Now, needle N0 need not actually knit at feeder F4 (color A). Whether it does or not is determined by the patterning data. Needle N0 will knit, however, at one of the feeders (F4-F7) of the second feeder group. When a pattern having a tuck or blister stitch is selected, certain needles will knit twice in a feeder group.

A study of FIGS. 4A, 4B, 4C, and 4D will show that the staggered short vertical lines represent the location of the change point on the illustrative knitting machine just before it enters each feeder on each revolution when knitting a four-color plain pattern. Thus, during revolution 9, for example, when the change point is just ready to enter the feeder F20, indicated at reference numeral 25 on FIG. 4B, feeder F20 is ready to change from knitting stitch row 78 to knitting stitch row 87. At this time, feeders F21, F22, and F23 are knitting stitch row 78; feeders F24-F27 are knitting stitch row 79; and feeders F16-F19 are knitting stitch row 86.

In the illustrative combination of a 1872-needle, 36-feeder knitting machine and a pattern 216 stitch rows high, 24 knitting machine revolutions are required to knit a complete four-color plain pattern. Therefore, after 24 machine revolutions, the above described pattern sequence repeats. This may be visualized by imagining FIGS. 4A, 4B, 4C, and 4D to be continuous upon the surface of a cylinder, the next revolution following revolution 23 being revolution 0.

As noted above, the needle actuators (A0-A12 of FIG. 2) in each of the feeders are sequentially enabled by actuator enabling signals from a machine driven encoder. Knitting pattern data is stored on a magnetic disc which rotates at 3600 RPM, or 60 revolutions per second. This enables the magnetic disc to be scanned and pattern data read if required approximately once during each advance of the needle cylinder by 10 needles with the needle cylinder rotating at 20 RPM. Stored data is read from the disc into temporary storage means and is used to selectively activate actuators which have been enabled by signals from the encoder. Thus, during the time interval an actuator is enabled by a signal from the encoder, it will be activated by a pattern data signal if the pattern requires the next needle associated with that actuator to non-knit.

Figure 5:
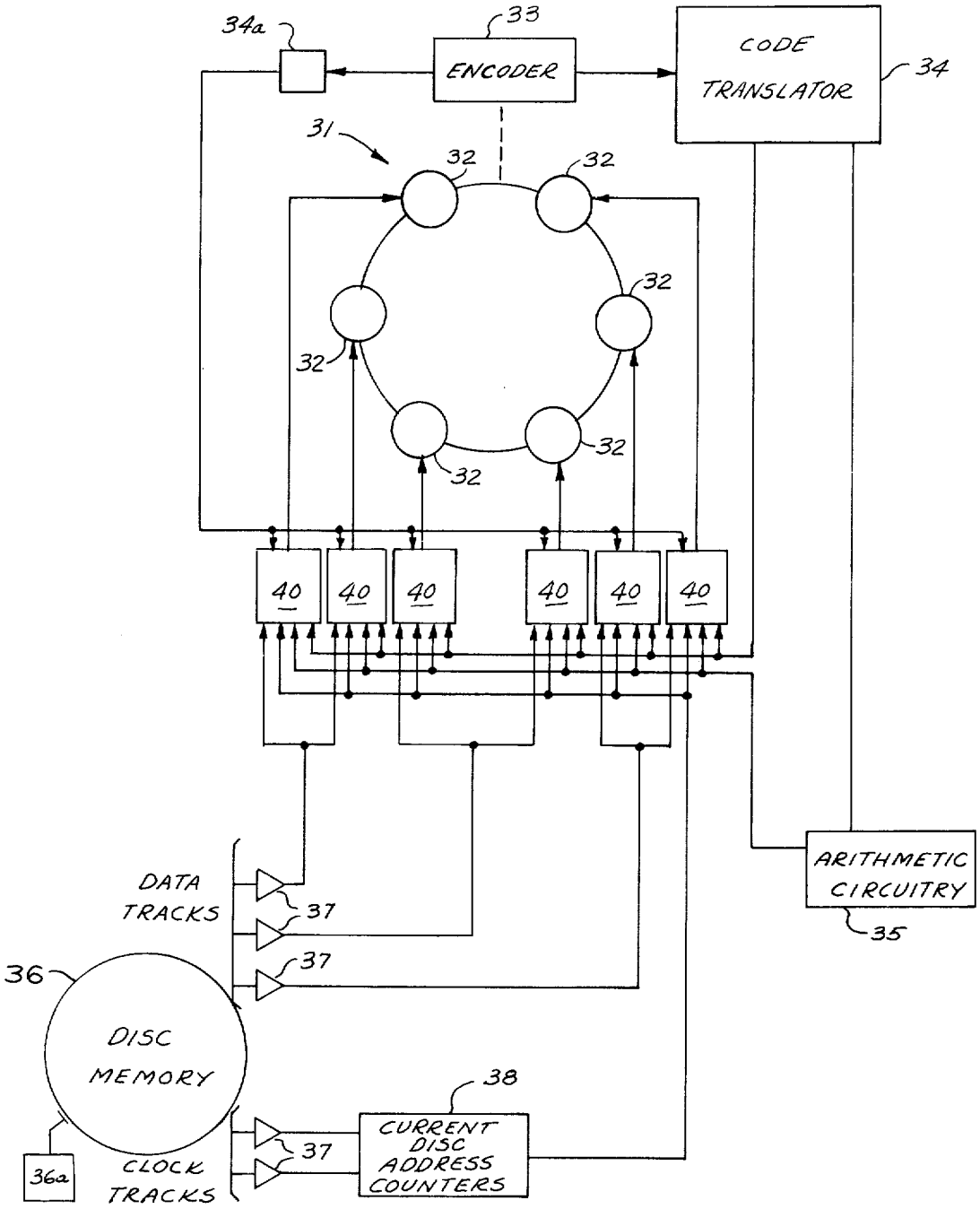
FIG. 5 is a simplified schematic block diagram of the knitting machine control system of the present invention.

FIG. 5 shows a simplified block diagram of the knitting machine control of the present invention for selectively reading the required data from the disc and supplying it to the proper actuators as required. A circular knitting machine is represented at 31 and has a plurality of feeder means 32. An optical shaft encoder 33 is coupled to the knitting machine 31 so that the input shaft of the encoder rotates in timed relationship to the cylinder of knitting machine 31. The encoder provides a plurality of binary coded signals to a code translator 34 which transforms them into an actuator count number, a byte count number, a feeder count number, and a revolution count number. The encoder also provides signals to multivibrator circuits 34A which produce needle clock and sync signals, the use of which will be described subsequently. Arithmetic circuitry 35 operates to subtract 1 from the revolution count number to provide the previous revolution count number, and to add 2, 4, and 6 respectively to the byte count number to provide offset byte count numbers the use of which will be described subsequently.

A magnetic disc memory device 36 has a plurality of recording tracks thereon, two of which are used for storing clock pulses for use in transferring data to and from the disc, and the remainder of which may be used for data storage. Each track has a reading head (not shown) and a reading amplifier 37. The signals from the clock tracks drive a set of current address counters 38 which are continuously up-dated to indicate the zone, sector, byte, and bit addresses of data under the reading heads. The data from the memory disc is utilized to selectively activate the actuators during the time intervals they are enabled under the influence of the encoder 33. Of course, whether or not a particular actuator is activated while it is enabled depends upon the pattern being knitted. Each feeder 32 has associated therewith feeder circuitry 40 for utilizing signals provided by the encoder 33 and memory disc 36. For example, each feeder control 40 includes one or more shift registers for temporarily storing pattern data from the memory disc 36 before it is used by an associated one of the feeders 0–35. Each shift register is loaded with data from the disc under the control of a comparator, which compares the address of the next data that will be required with the current address of data under the reading heads and initiates a data transfer from the disc to a shift register when the current disc address corresponds with the address of the required data. The address of the next required data is produced by the encoder and its associated translator circuitry. The feeder control 40 further includes gating circuitry responsive to actuator enabling signals from code translator 34 to sequentially enable each of the actuators at each feeder during the passage of each echelon of selector jacks.

Figure 6:
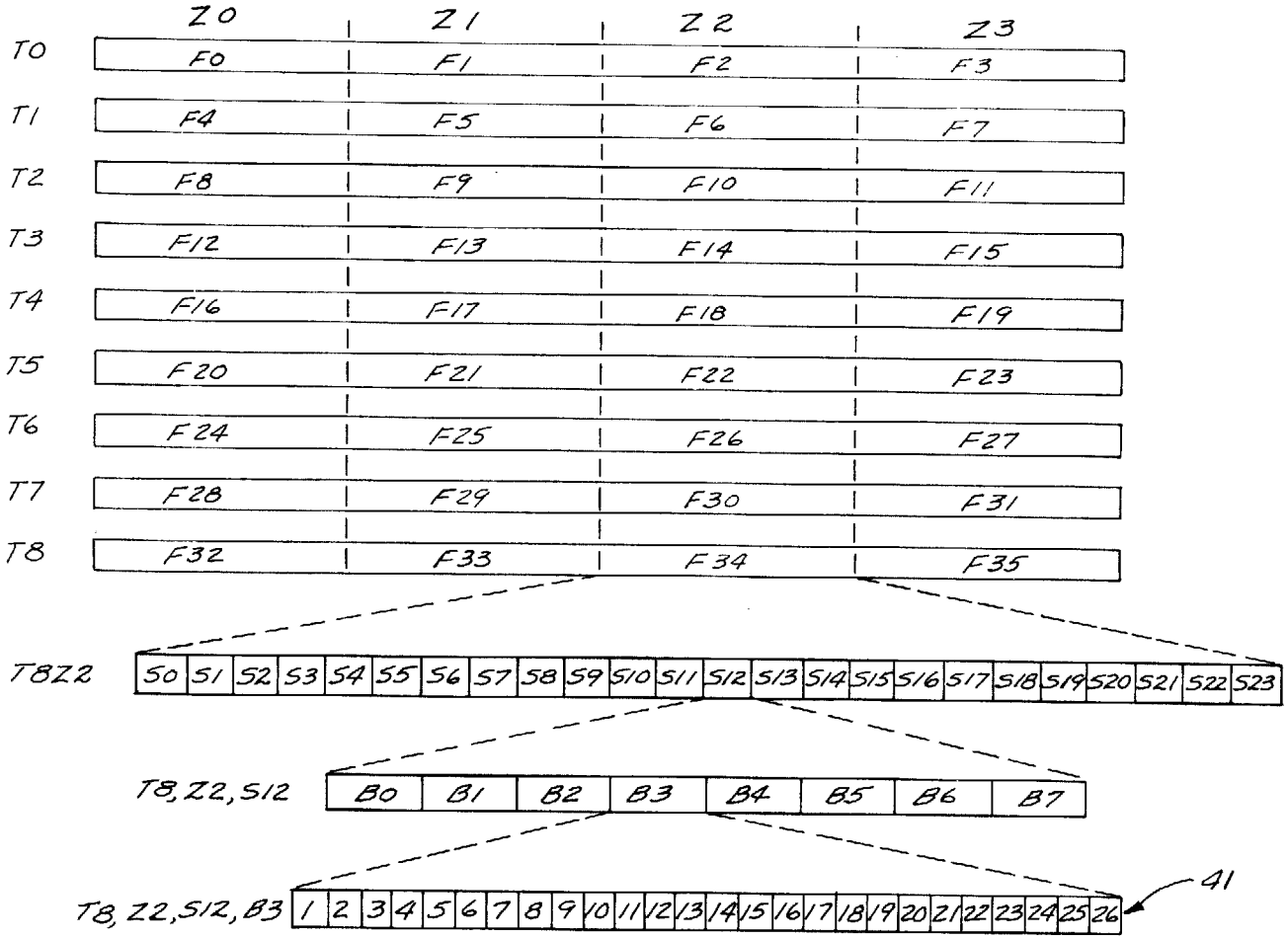
FIG. 6 is a diagram showing the memory address arrangement used on the magnetic disc.

Although different numbers of data tracks could be utilized in different circumstances, the presently preferred magnetic disc 36 utilizes nine data tracks, T0-T8, a bit clock track T9, and an origin clock track T10. FIG. 6 shows the arrangement of the knitting pattern data on the data tracks. Each track T0-T8 is divided into four zones identified by reference characters Z0-Z3. Each zone has capacity to store all of the knit and non-knit commands required to control one feeder during the knitting of the maximum size pattern of which the control is capable. In the selected four-color plain pattern, this would be a 208 stitch by 216 stitch row pattern requiring four feeders per stitch row. As described above, it requires 24 revolutions to knit the selected four-color plain pattern on the illustrative machine. Since each feeder group will knit 24 stitch rows of the selected 208 stitch wide four-color pattern and since data must be stored to indicate whether each feeder is to knit or non-knit on each stitch of the 24 stitch rows, each zone contains 4992 bits to control the operation of the associated feeder during the knitting of the selected pattern.

Each zone is subdivided into 24 sectors S0-S23. Each sector has a bit capacity sufficient to store all of the knit and non-knit commands required to control one feeder for one full stitch row of the maximum size pattern. In the illustrative machine and pattern, this is 208 bits. Each sector is further subdivided, for purposes that will be more fully described below, into eight bytes, referred to as B0-B7, of 26 bits each.

Thus, referring again to FIG. 6, it will be seen that track T0, zone Z0 contains all the pattern data for feeder F0. Track T0, zone Z1, contains the data for feeder F1. Track T0, zone Z2, contains the data for feeder F2. The data for feeders F4-F7 is on track T1, the data for feeders F8-F11 is on track T2, etc. As illustrated in FIG. 6, track T8, zone Z2, contains the data for feeder F34. Zone Z2 is divided into 24 sectors (as are the other zones), the data in each sector (S0-S23) containing data for feeder F34 for one pattern stitch row. For example, sector S12 contains the data for stitch row 117 of the pattern, which will be used by feeder F34 for one full revolution starting during knitting machine revolution 12 and ending during knitting machine revolution 13. It should be remembered that the knitting machine revolutions are numbered starting with zero. Sector S12, as is every other sector, is subdivided into eight bytes, B0-B7, of 26 bits each. The 26 bits of byte B3, sector S12, zone Z2, track T8, are represented at 41 in FIG. 6.

A pattern is encoded stitch row by stitch row in a binary code wherein a "1" indicates knit and an "0" indicates non-knit. Of course, this could easily be reversed so that a "0" would indicate knit and a "1" non-knit. As noted above, the data for feeder F0 is located on track T0 in zone Z0. This is further broken down so that feeder F0 data for knitting machine revolution 0 is stored in sector S0, data for knitting machine revolution 1 is stored in sector S1, data for the revolution 2 in S2, etc. Data for the remaining feeders is similarly located in their respective tracks, zones, and sectors.

By way of example, assume a three-color plain pattern with the illustrative machine threaded according to FIG. 3. In this case, track T0, zone Z0, sector S0 will contain the first stitch row data for color A; track T0, zone Z1, sector S0 will contain the first stitch row data for color B; and track T0, zone Z2, sector S0 will contain the first stitch-row data for color C. Track T0, zone Z3, sector S0 will contain the second stitch-row data for color A. Track T0, zone Z0, sector S1 will contain the thirteenth stitch-row data for color A, because on the second revolution of the knitting machine (revolution 1) feeder F1 is knitting in the thirteenth stitch row of the pattern. Assuming a 216 stitch row three-color plain pattern, the pattern will be completed after eighteen revolutions of the knitting machine. Therefore, sectors S18 through S23 of each zone are not used.

It should be recognized that track, zone and sector are merely convenient terms for defining data addresses, and that other address formats could have been used. The above described address format is currently preferred. One of the outstanding features of the preferred data address system is that it permits rapid trouble-shooting of any data errors, and facilitates making minor changes in patterns. For any given type of pattern, e.g. four-color plain or two-color blister, each stitch of each stitch row of the pattern will be defined by a data bit stored in a known disc address.

Two different data transfer systems have been designed to retrieve knitting from the disc and supply it as required to the feeder actuators as described above and illustrated in FIG. 5. In both systems, data is read from the disc in serial groups of bits into buffer storage and from the buffer storage is supplied to the actuators. The sizes of the groups of bits transferred and the buffer storage arrangements for the two systems are different. Both of these systems will be described herein.

SYSTEM A

Figure 7:
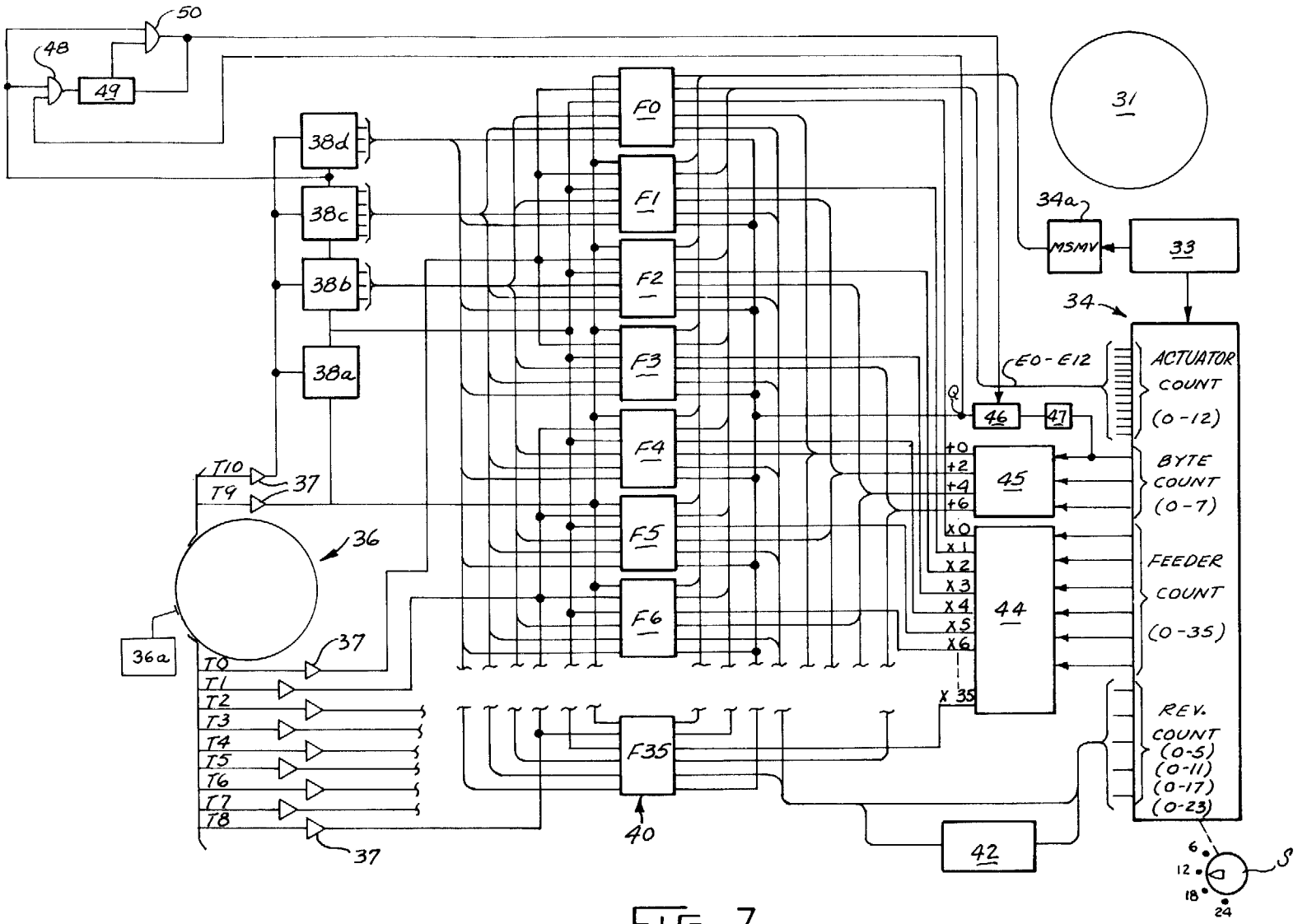
FIG. 7 is a schematic block diagram of one data transfer system used in the knitting machine control of the present invention.
Figure 8:
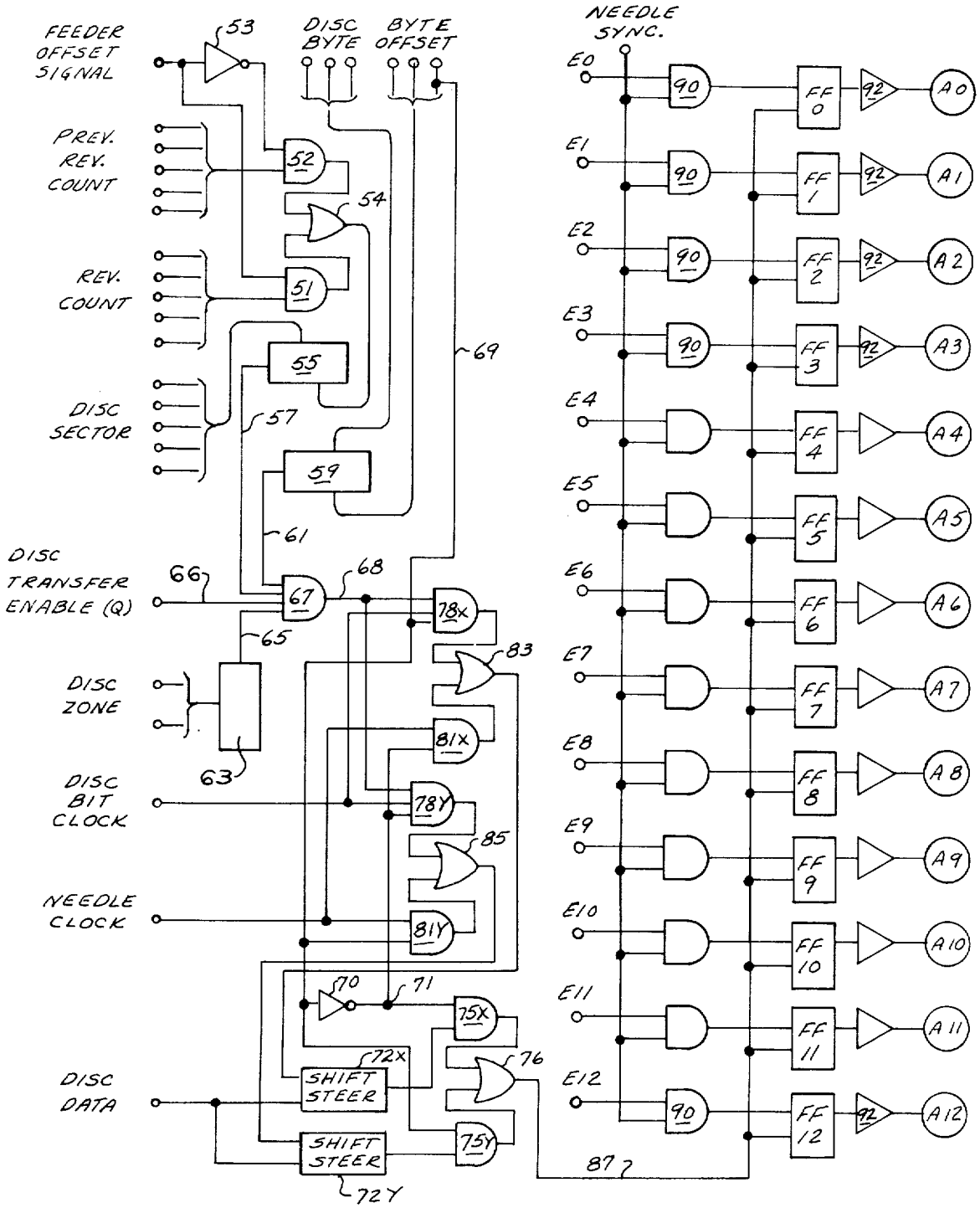
FIG. 8 is a more detailed schematic block diagram of the data transfer system of FIG. 7 for a single feeder.

In one data transfer system, which will be referred to as system A, and which is diagramatically illustrated in FIGS. 7 and 8, pattern data is recorded on the disc 36 from a data source **36*a*, such as a tape or card reader or keyboard with suitable buffer storage to provide a time interface between the data source and disc. Data is transferred from the relatively rapidly rotating disc 36 via reading heads and track amplifiers 37. Each reading head has its own track amplifier 37, and therefore, all nine data tracks T0-T8 may be read simultaneously. Data transfer from the disc is clocked by pulses from the disc bit clock track T9, which also drive the current disc address counters 38. These are binary counters, the first of which is the bit counter 38***a*, which repetively counts from 0–25 (26 counts). Each time bit counter 38*a* rolls over, it supplies a pulse to byte counter 38*b*, which repetitively counts from 0–7 (8 counts), and at any given instant indicates the byte address of data under the nine reading heads for the data tracks T0-T8. Each time the byte counter 38*b* rolls over, it supplies a pulse to sector counter 38*c*, which repetitively counts from 0–23 (24 counts), and at any given instant indicates the sector address of data under the reading heads. Each time the sector counter 38*c* rolls over, it supplies a pulse to zone counter 38*d*, which counts repetitively from 0–4 (5 counts), and at any given instant indicates the zone address of data under the reading heads. There is no zone Z4, as such. There is, however, an unused portion of the disc between the end of zone Z3 and the beginning of zone Z0. Therefore, to identify the unused portion and present a data transfer when it is under the reading heads, it is treated as zone Z4, which is never addressed by the data transfer circuitry. The disc origin clock track T10 supplies one pulse per revolution of the disc. This pulse is used to reset all of the counters 38 to zero so that the counters are reliably synchronized with the actual disc position every revolution of the disc.

The translator circuitry 34 receives its input from encoder 33 and provides four binary arithmetic outputs; the actuator count numbers, the byte count number, the feeder count number, and the revolution count number. Each of the outputs except the revolution count number is cyclic within a single revolution of the knitting machine. The revolution count number, however, must cycle once for each complete pattern height knitted. The reason for this will be explained subsequently.

The number of knitting machine revolutions required to knit a complete pattern height of 216 stitch rows depends upon the number of feeders per stitch row required to knit the particular pattern. Thus, a four feeder per stitch row pattern requires 24 revolutions, a three feeder per stitch row pattern requires 18 revolutions, and a two feeder per stitch row pattern requires 12 revolutions. For this reason, the revolution count number is selectable to repetitively count from 0–5 (6 revolutions), from 0–11 (12 revolutions), from 0–17 (18 revolutions), or from 0–23 (24 revolutions), depending upon the number of revolutions required to complete one pattern height. This selectability also provides flexibility in the pattern heights that may be chosen. For example, if the pattern height were 108 stitch rows, then 12 revolutions would be required for a four feeder per stitch row pattern, and 6 revolutions would be required for a two feeder per stitch row pattern. It will be seen that a large number of combinations of pattern types and heights can be knitted on the illustrative machine in 6, 12, 18, and 24 revolutions. Although the translator 34 could be set to count different numbers of revolutions in many different known ways, a manually engageable selector S is provided to enable the revolution count to be varied to suit the selected pattern. One specific arrangement for providing this selectability is disclosed in the aforementioned Schuman patented.

While it is contemplated that the pattern data on the disc 36 will be varied by a suitable recording means, it should be understood that a plurality of discs 36 could be used interchangeably, each disc having data corresponding to a particular pattern. Also, matrix type core storage could be used in place of a disc, but is not presently economical in this particular usage.

One sector on a disc data track of the disc 36 contains the knitting data for one stitch row of the pattern and will supply one feeder for a full revolution of the knitting machine. The revolution count number from translator circuitry 34 is used to derive the disc sector address of the next data required by each feeder. Disc sector address and revolution count number will always be the same for each feeder behind the change point. For feeders in front of the change point, sector addresses are one less than the revolution count number. Therefore, in order to supply the proper sector address for each feeder in front of the change point, arithmetic circuitry 35 includes a subtractor 42 which subtracts 1 from the revolution count number to provide the previous revolution count number. Gating circuitry included in each feeder control 40 selectively connects either the current revolution count number or the previous revolution count number to a comparator in each feeder control 40 in accordance with a feeder offset signal from feeder offset generator 44.

The input to feeder offset generator 44 is provided by the feeder count number from translator circuitry 34. The feeder count number leads the current location of the change point with respect to the feeders around the knitting machine by 26 needle positions plus an additional amount, say two needle positions, to allow for operating time of the actuators. The feeder offset generator 44 generates from the feeder count number a feeder offset signal X0-X35 for each feeder of the knitting machine. The feeder offset signal leads the change point by the same distance as the feeder count number. Assume the amount of the lead is actually 26 needle positions. Each feeder offset signal remains at the zero logic level from 26 needle positions before the time the change point enters feeder F0 until 26 needle positions before the change point starts to enter its associated feeder. For example, the feeder offset signal X12 for feeder F12 goes to zero 26 needle positions before the change point enters feeder F0 and remains at the zero logic level until 26 needle positions before the change point enters feeder F12 at which time X12 changes to a logic 1 level and remains there until the change point again reaches the location 26 needle position before entering feeder F0. The feeder offset signal X23 for feeder F23 goes to logic zero 26 needle positions before the change point enters feeder F0 and remains there until 26 needle positions before the change point reaches feeder F23 at which time X23 changes to a logic 1 level. The feeder offset signal X0 for feeder F0 is always at the logic 1 level. This is because the instant the change point is 26 needle positions before entering feeder F0 it is also at the position to go to logic 1 and, therefore, would be at the logic zero level for zero time.

Further, by way of example, assume the knitting machine is on revolution 11. The feeder offset signal X24 for feeder F24 will be at logic zero for most of the revolution, having gone to logic zero 26 needle positions before the change point entered feeder F0, and remaining there until 26 needle positions before the change point enters feeder F24. Just before X24 went to logic zero during revolution 11, the revolution count number was 11 and feeder F34 was being supplied with data from sector S11. When X24 goes to logic zero, the revolution count number also changes from 11 to 12. With X24 now at logic zero, feeder F24 will continue to be supplied with data from sector S11 until 26 needle positions before the change point enters feeder F24 because the previous revolution number is now 11.

On knitting machine revolution 12 and more than 26 needle positions before the change point enters feeder F24, one of the two 26-bit shift registers associated with feeder F24 will be loaded with data from sector S11. When the change point reaches 26 needle positions before feeder F24, feeder offset signal X24 goes to logic one. The logic one level of X24 will cause the next data loaded into the other 26-bit shift register associated with feeder F24 to be drawn from sector S12, because the current knitting machine revolution count number is then 12. Thus, it will be seen that the feeder offset signal for each feeder properly selects the current revolution or the previous revolution number to identify the sector address of data needed by each feeder from the disc.

Arithmetic circuitry 35 also includes a byte offset generator 45 that adds 2, 4, and 6 to the byte count number. Byte offset generator 45 provides four byte offset signals that indicate respectively the byte count number, the byte count number plus 2, the byte count number plus 4, and the byte count number plus 6. The byte count number will never be larger than seven (binary 111). Therefore, by way of example, if the byte count number is five (binary 101), byte count number plus 2 will be 7 (binary 111), and the byte count number plus 6 will be 3 (binary 011). Since there are 52 needles per feeder, there are two 26-bit bytes per feeder. Therefore, each feeder around the knitting machine lags its preceding feeder in time or needle position by two bytes. Thus, the byte offset number having zero offset provides the disc byte address for feeders F0, F4, F8, etc. The byte offset number having plus 6 offset (same as minus 2 offset) provides the disc byte address for feeders F3, F7, F11 etc. The The byte offset number having plus 4 offset (same as minus 4 offset) provides the disc byte address for feeders F2, F6, F10, etc. The byte offset number having plus 2 offset (same as minus 6 offset) provides the disc byte address for feeders F1, F5, F9, etc.

In order to prevent multiple reading of the data on the rapidly turning memory disc 36 each time new data is required by a feeder, the set output of a flip flop 46 is used to provide a disc transfer enable signal Q which restricts each disc data transfer or readout to approximately one full revolution of the disc. The set input of flip flop 46 is connected to a differentiator circuit 47 that is connected to the units digit signal of the byte count number. Each time the byte count number changes, circuit 47 produces a pulse that sets flip flop 46. The set output Q of flip flop 46 is connected to one input of an and gate 48, the output of which is connected to the input of a 3-stage binary counter 49. The other input to and gate 48 is provided by the pulse output of counter 38*c*, which also provides one input of a 2-input and gate 50, the other input of which is provided by the third stage of counter 49. Counter 49 counts in the normal binary sequence, 000,001,010,011,100, etc. The counter 49 is initially in the 000 state. The output of and gate 50 is connected to the reset inputs of flip flop 46 and the counter 49. Therefore, the counter 49 never counts past binary four (100). This enables the reading heads to start their scan in the middle of a zone and scan the unused area of the disc 36 as well as fully scanning the initial zone before the counter 49 is reset.

In operation, each time the byte count number changes, circuit 47 produced a pulse which sets flip flop 46, causing its set output Q to go from logic zero to logic one, which enables and gate 48 to pass zone pulses to counter 49. After four zone pulses, counter 49 will be in the binary 100 state, enabling and gate 50. Thus, the fifth zone pulse passes through and gate 50 to reset counter 49 to the 000 state, and to reset flip flop 46, changing the set output Q from logic one to logic zero. No further disc data transfer can occur until the byte count number changes again. The disc 36, of course, may revolve several times before this happens.

FIG. 8 is a detailed block diagram of one of the feeder controls 40 which activates actuators A0-A12 in an associated one of the feeders F0-F35 in accordance with pattern data stored on the disc 36. To provide for a transfer of data from the proper sector of the disc 36 to a storage register and subsequently to the actuators A0 to A12, the sector address under the reading heads for the disc 36 must be compared with the revolution count number. Of course, the revolution count number for each feeder is adjusted to provide for feeder offset before the pattern change point reaches the feeder. Therefore, the previous knitting machine revolution count number is compared with the disc sector address until a predetermined number of needle positions before the change point enters the feeder associated with the specific controls 40 of FIG. 8. (In our previous example, 26 needle positions is used as this predetermined number.) When the needle cylinder moves to within the predetermined number of needle positions (i.e., 31) before the feeder, the present knitting machine revolution count is compared with the disc sector address.

Accordingly, each stage of the revolution count number from the translator 34 provides one input to a plurality of and gates 51. Similarly, each stage of the previous revolution count number from the subtractor 42 (FIG. 7) provides one input to a plurality of and gates 52 (FIG. 8). The second inputs of and gates 51 are provided by the feeder offset signal from the feeder offset generator 44 (FIG. 7) and the second inputs of and gates 52 are provided by the inverse of the feeder offset signal generated by inverter 53 (FIG. 8). Thus, when the feeder offset signal is zero, the inverse of the feeder offset signal is at logic 1 enabling and gates 52 to gate the previous revolution count number through or gates 54 to five-stage digital comparator 55. When the change point moves to within a predetermined number of needle positions (i.e. 31) before the feeder, the feeder offset signal goes from logic zero to logic 1 and the revolution count number is gated via and gates 51 and or gates 54 to comparator 55. Thus, the feeder offset signal selectively controls the gating of the revolution count number or the previous revolution count number to comparator 55. The current disc sector address of the data under the reading heads of disc 36 is also connected to comparator 55 from counter 38*c*. The comparator 55 provides a logic 1 level on line 57 only when its two five-stage inputs are identical.

In addition to comparing the knitting machine revolution count number with the sector address, the byte count offset number must be compared with the disc byte address of the data from the disc 36. Therefore, the disc byte address from counter 38*b* and the byte offset number from byte offset generator 45 are compared by a three stage digital comparator 59. The comparator 59 provides a logic 1 output on its output line 61 only when both of its three-stage inputs are identical, that is when disc byte address and the byte offset number coincide.

Furthermore, the disc zone (Z0-Z3) on the disc 36 being read must coincide with the zone for the particular feeder associated with the controls 40 of FIG. 8. The disc zone address from counter 38*d* provides one input to a three-stage digital comparator 63. The other input of comparator 63 is hard wired to indicate the disc zone address where data for the feeder in question is located. Similar to comparators 55 and 59, comparator 63 provides a logic 1 output on line 65 only when both of its inputs are identical.

When the current disc address (zone, sector, and byte) coincides with the zone, revolution count number, and byte offset number for the feeder associated with the controls of FIG. 8, an enabling signal is provided to allow data to be transferred from the memory disc to a storage register in the feeder controls 40. Thus, lines 57, 61, and 65 are connected to the inputs of a four-input and gate 67 the output of which will be at the logic 1 level only when all of its inputs are at the logic 1 level. To prevent double reading of data, the line 66, which carries the disc transfer enabling signal Q, is also connected to the gate 67.

In system A, each feeder control 40 contains two 26-bit shift registers 72. Shift register 72X provides knitting data to activate the actuators (A0-A12) during even-numbered bytes, while shift register 72Y is being loaded with the next byte of data from the disc. During odd-numbered bytes, shift register 72Y provides knitting data to activate the actuators while shift register 72X is loaded with the next byte of data from the disc. To provide a gating control signal indicative of whether an even or odd numbered byte is presently being knitted, the least significant binary digit of the byte offset number is connected by way of a line 69 to an inverter 70. When the byte offset number is even, line 69 is at logic zero level. When the byte offset number is odd, line 69 is at the logic 1 level. The output line of inverter 70, indicated at 71, will be at the inverse logic level of line 69.

Two and gates 75X and 75Y and an or gate 76 gate the output stages of shift registers 72X and 72Y to the steering inputs of steered flip flops FF0-FF12. And gate 75X is enabled during even numbered bytes by the signal on line 71 and and gate 75Y is enabled during odd numbered bytes by the signal on line 69. Thus, during even numbered bytes and gate 75X is enabled so that the output stage of shift register 72X is connected via and gate 75X and or gate 76 to the steering inputs of flip flop FF0-FF12. During odd numbered bytes and gate 75Y is enabled and the output stage of shift register 72Y is connected via and gate 75Y and or gate 76 to the steering inputs of flip flops FF0-FF12.

One of the registers 72X or 72Y is enabled for loading with pattern data from the disc 36 (transmitted over one of the leads T0-T8 of FIG. 7) while the other register is providing pattern data signals to effect activation of the actuators A0-A12. Therefore, a circuit arrangement is provided to enable the register 72X to be loaded with pattern data and to prevent the loading of pattern data into the register 72Y during odd numbered bytes. Similarly, the circuit arrangement enables the register 72Y to be loaded with pattern data and prevents the loading of pattern data into the register 72X during even numbered bytes.

Accordingly, two pairs of and gates 78, 81, and two or gates 83, 85, alternately connect the disc (T9 of FIG. 7) bit clock and needle clock (from the multivibrator circuit 34*a* of FIG. 7) to the shift inputs of shift registers 72. And gates 78*x* and 81*y* have one input connected to line 69 which enables those gates during odd numbered bytes. And gates 78*y* and 81*x* each have one input connected to line 71 which enables those gates during even numbered bytes. Gates 78 each have a second input connected to line 68 which enables those gates when the zone, sector and byte numbers and disc addresses are identical. The third inputs of and gates 78 are connected to the disc bit clock while the second inputs of gates 81 are connected to the needle clock.

From the foregoing description, it should be understood that during an odd numbered byte the gate 78*x* enables the register 72*x* to receive data from the disc 36 over an associated one of the leads T0-T8 of FIG. 7. During the next following even numbered byte the gate 81*x* enables the register 72*x* to transmit the data received during the previous odd numbered byte. Similarly, during an even numbered byte the gate 78*y* enables the register 72*y* to receive data from the disc 36 over the associated one of the leads T0-T8. During the next following odd numbered byte the gate 81*y* enables the register 72*y* to transmit the data received during the previous even numbered byte.

During operation of the knitting machine 31, the actuators A0-A12 are sequentially enabled in a timed relationship with rotational movement of the needle cylinder and in accordance with data from register 72*x* or 72*y*. Since the actuators A0-A12 are enabled in a timed relationship with rotational movement of the needle cylinder, data is transmitted from the register 72 in timed relationship with rotational movement of the needle cylinder. To provide these two timed relationships, the needle sync and needle clock signals are produced by monostable multivibrator circuitry 34*a* (FIG. 7) which is triggered by signals from photocell reading the finest code track of encoder 33. The needle sync signal comprises a series of short pulses, one pulse occurring for each advance of the knitting machine cylinder by one needle position. The needle sync signal is used to load the actuator flip flop F0-F12 (FIG. 8) with the bits in the output stage of shift registers 72. The needle clock signal comprises a series of short pulses, one pulse occurring immediately after each needle sync pulse. The needle clock pulses are used to shift shift registers 72 to make the next data bit available in the output stages. The operation of the encoder 33 in producing the needle sync and needle clock signals is more fully set forth in application Ser. No. 192,984 Filed Oct. 27, 1971 by Ralph H. Schuman now U.S. Pat. No. 3,831,402 and entitled Knitting Machine Encoder.

From FIG. 8 it is apparent that during even bytes the needle clock will be connected via and gate 81*x* and or gate 83 to shift register 72*x* and that during odd bytes the needle clock will be connected via and gate 81Y and or gate 85 to shift register 72Y. Also, during even bytes the disc bit clock output will be connected via and gate 78Y and or gate 85 to shift register 72Y and during odd bytes the disc bit clock will be connected via and gate 78X and or gate 83 to shift register 72X; provided that the disc zone, sector and byte addresses are identical, respectively, to the zone, revolution count, and byte offset numbers of the feeder in question, and disc transfer enable signal Q is at logic one. It will be seen, therefore, that the next byte of data required will be clocked from the disc to one of the shift registers 72 by the disc bit clock. While this is occurring, data is being clocked out of the other shift register 72 to the actuators A0-A12 in timed relationship with rotational movement of the needle cylinder by the needle clock. In this manner, the output of or gate 76 provides a continuous stream of knitting data via line 87 to the steering inputs of steered flip flops FF0-FF12.

The actuators A0-A12 are sequentially enabled to respond to pattern data in timed relationship with rotation of the needle cylinder. Accordingly, a plurality of and gates 90 each has one input connected to receive one of the actuator enabling signals E0-E12 from the translator 34 (FIG. 7). The other input of each and gate 90 (FIG. 8) is connected to receive the needle sync signal from the circuitry 34*a* of FIG. 7. Also, each and gate 90 has its output connected to the strobe input of one of the flip flops FF0-FF12. Thus, flip flop FF0 will be strobed during the time that the first bit of a byte is in the output stage of the register 72, determining the logic level of line 87 and will be set accordingly. Likewise, flip flop FF1 will be set according to the second bit of the byte, flip flop FF2 will be set according to the third bit of the byte, etc., with flip flop FF12 being set according to the thirteenth bit of the byte. At this point the actuator enabling signal sequence repeats and flip flop FF0 will be set according to the fourteenth bit of the byte. In this manner, the knitting data is sequentially delivered to the flip flops FF0-FF12, the outputs of which energize the electromagnetic actuators A0-A12 via power amplifiers 92.

The knitting machine controls of FIGS. 7 and 8 facilitate the knitting of many different types of patterns with a minimum of difficulty. This is because address signals provided by the translator 34 can be utilized with many different patterns by merely adjusting the selector S to a setting corresponding to the number of needle cylinder revolutions in which the pattern is to be repeated. Of course, the pattern data on the disc 36 or other data storage medium must be varied to provide the desired pattern. Thus, for a three-color plain pattern having 216 stitch rows, the selector S is set for a revolution count of 0–17 so that the address signals from the translator 34 are repeated each time the needle cylinder rotates through 18 revolutions to thereby effect a repeated knitting of the pattern in accordance with the data stored on the disc 36. When a four-color plain pattern having 216 stitch rows is to be knitted, it is merely necessary to change the pattern data on the disc 36 by means of the data source 36A and to set the selector S to a needle cylinder revolution count of 0–23. Of course, the pattern and the address signals from the translator 34 will then be repeated each time the needle cylinder rotates through 24 revolutions.

SYSTEM B

Figure 9:
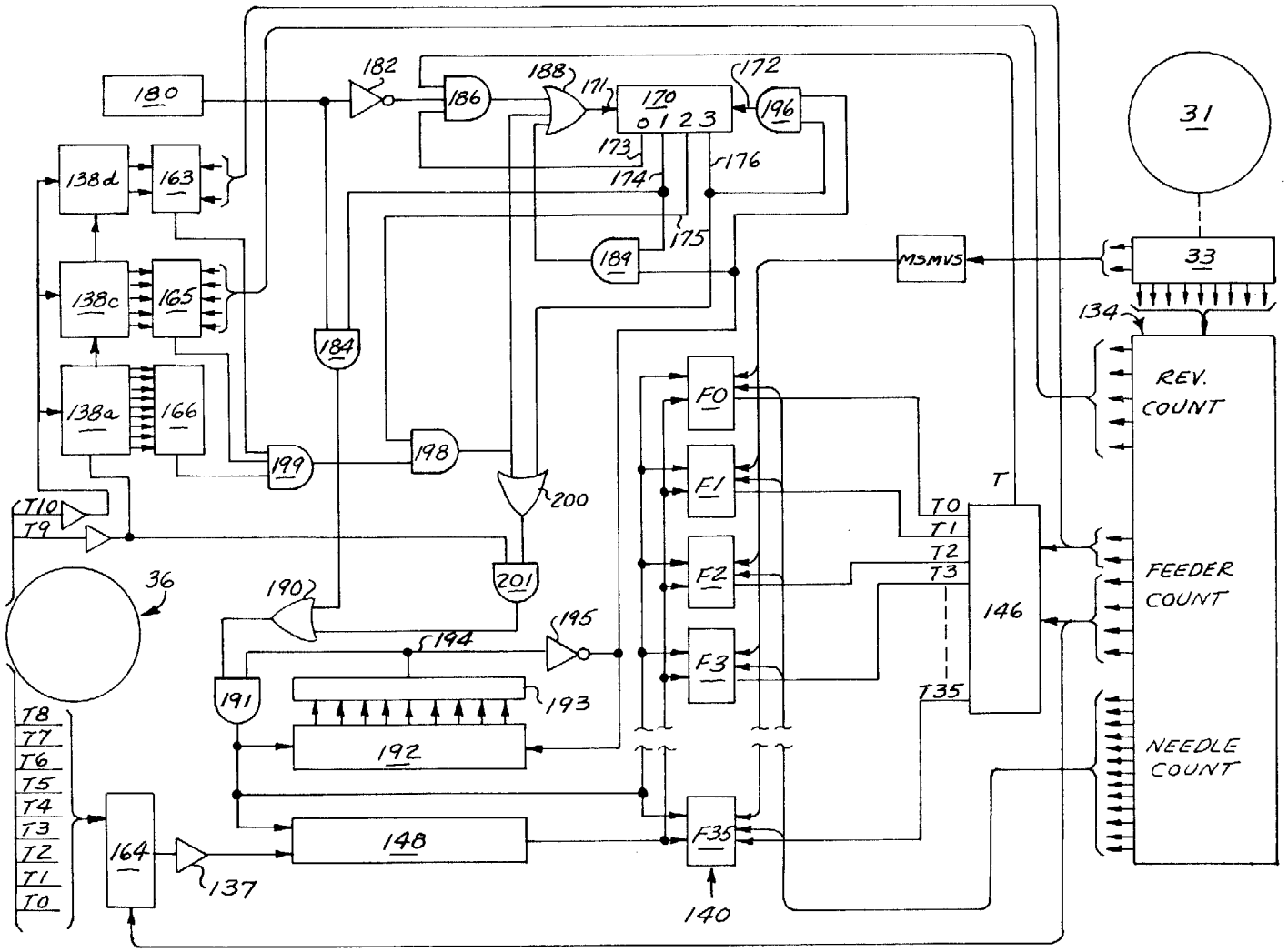
FIG. 9 is a schematic block diagram of an alternate data transfer system used in the knitting machine control of the present invention.
Figure 10:
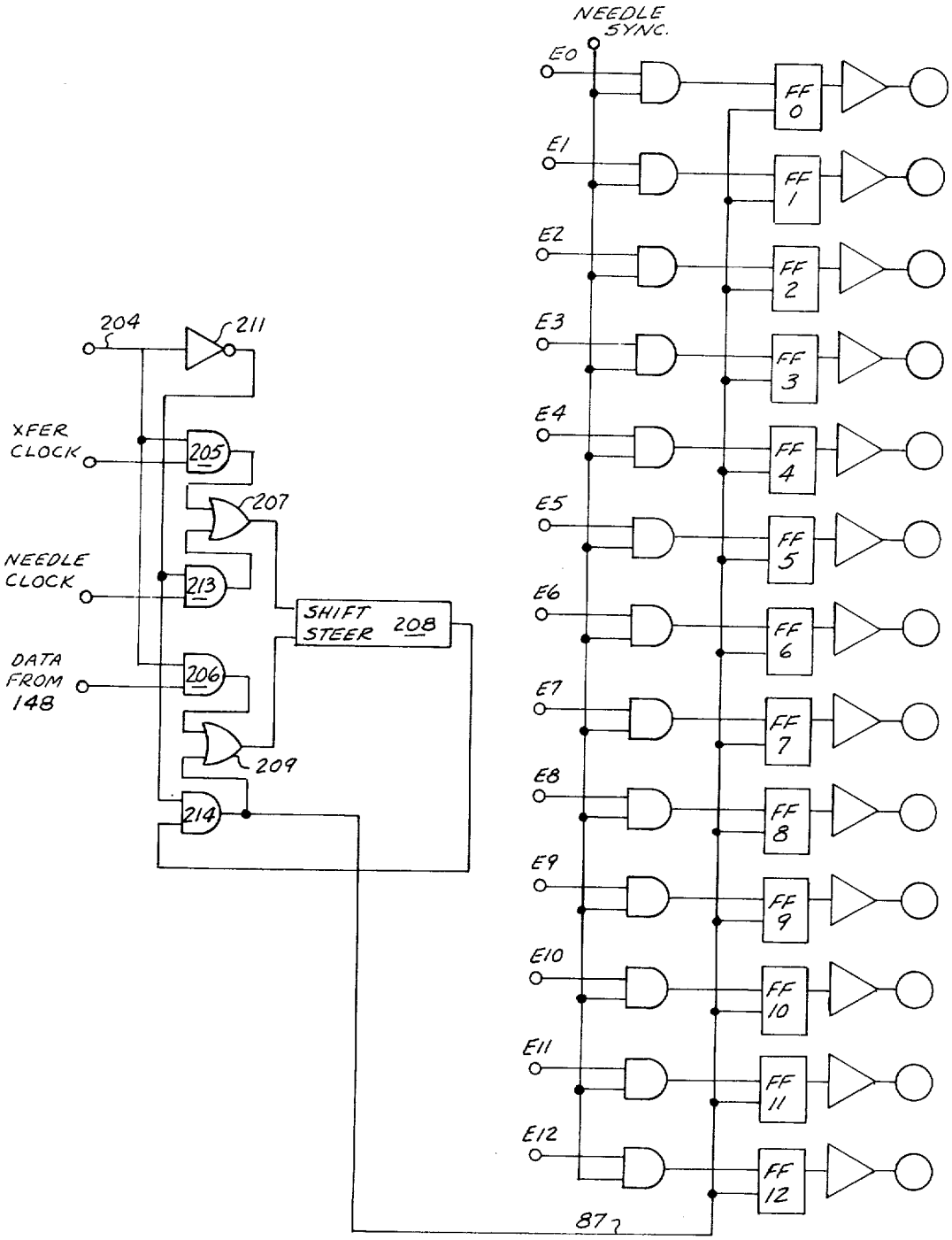
FIG. 10 is a more detailed diagramatic block diagram of the data transfer system of FIG. 9 for a single feeder.

On the second embodiment of the invention, which will be referred to as data transfer system B, and which is diagramatically illustrated in FIGS. 9 and 10, data is transferred from the pattern memory disc 36 via reading heads, one for each data track, and a single track amplifier 137 in serial groups of 208 bits. Due to the timing arrangement of data transfers from the disc in system B, all nine data tracks T0-T8 may share a single track amplifier. Data transfer from the disc, as in system A, is clocked by pulses from the disc bit clock track T9, which drives current disc address counters 138. The first of these is the bit counter 138*a*, which repetitively counts from zero — 207 (208 counts). Each time bit counter 138*a* rolls over, it supplies a pulse to sector counter 138*c*, which repetitively counts from 0–23 (24 counts), and at any given instant indicates the sector address of data under the reading heads. Each time the sector counter 138*c* rolls over, it supplies a pulse to zone counter 138*d* which counts repetitively from 0–4 (5 counts), and at any given instant indicates the zone address of data under the reading heads. As in system A, the disc origin track T10 supplies one pulse per revolution of the disc which is used to reset all of the counters 138 to zero so that the counters are reliably synchronized with the actual disc position every revolution of the disc.

Translator circuitry 134 provides three outputs; the actuator or needle count number, the feeder count number, and the revolution count number. As in system A, the revolution count number is selectable to repetitively count 6, 12, 18, or 24 counts. Again, one sector on a disc data track contains the knitting data for one feeder for a full revolution of the knitting machine. Therefore, the revolution count numbers from translator circuitry 134 may be used to derive the disc sector address of the next data required by each feeder. Unlike system A, however, system B does not require a previous revolution number nor does it require a byte number. Instead of a 26-bit data transfer to one of the shift registers for each feeder every 26 needle times, system B uses a 208 bit data transfer to a single shift register at each feeder once every revolution of the knitting machine. Because there is only one shift register for each feeder, transfer of data into it must occur very rapidly after the last bit of data in it has been used and before it must supply another bit of data to an actuator. In other words, this data transfer must take place in less than one needle time of the knitting machine. Because a disc search or scan to find the required pattern data may require up to 16-⅔ milliseconds, data cannot be directly transferred from the disc to the feeder shift registers. Therefore, a buffer shift register 148 is used as a time interface between the disc 36 and the individual feeder shift registers in feeder controls 140.

Referring now to FIG. 9, there is shown a logic block diagram of the circuitry for controlling buffer shift register 148. The feeder count number from translator circuitry 134 is used to select both the data track and the zone address of the next data to be transferred from the disc. The two least significant digits of the binary feeder count number directly indicate the required zone address and provide one input to a comparator 163, the other input of which is supplied by current address zone counter 138*d*. The four most significant digits of the feeder count number provide the control inputs for a gating matrix 164 that connects the proper data track reading head to track amplifier 137. The sector address of the next required data is provided, as in system A, by the revolution count number. The revolution count number provides one input to a comparator 165, the other input of which is provided by current address sector counter 138*c*. A zero detector 166 receives its inputs from the stages of bit counter 138*a* and produces a logic 1 output only when all inputs are zero.

The various modes or states of operation of the circuitry of FIG. 9 are under the control of a state register 170. State register 170 has a stepping input 171, a reset input 172, and four state outputs 173, 174, 175, and 176. The four states of state register 170 will be identified as state 0, state 1, state 2, and state 3. In state 0, the next data that will be required by a feeder control 140 is being held in register 148. In state 0, output 173 is at logic 1 while the other outputs are at logic zero. In state 1 data is transferred from the register 148 to a register in feeder controls 140. When the register 170 is in state 1, output 174 is at logic 1 while the other outputs are at logic zero. In state 2, the address of the data currently under the reading heads of disc 36 is compared with the address of the next data required by controls 140. When these two addresses agree and the register 170 is in state 2, loading of the storage register 148 is initiated and carried out. When the register 170 is in state 2, output 175 is at logic 1, while the other outputs are at logic zero. In state 3, the transfer of data from the register 148 is completed. When the register 170 is in stage 3, output 176 is at logic 1 while the other three outputs are at logic zero.

Transfer signal generator 146 generates from the feeder count number an individual transfer signal T0-T35 for each feeder control 140 and also generates a composite transfer signal T that initiates the data transfer. The transfer signals T0-T35 go from logic zero to logic 1 at the same locations of the change point as do the offset signals X0-X35 of System A. However, unlike signals X0-X35, transfer signals T0-T35 each remain at the logic 1 level for only 52 needle times and then reset to the logic zero level. Thus, transfer signal T5 will go from logic zero to logic 1 when the change point reaches 31 needle positions before feeder F5 and return to logic zero when the change point reaches 31 needle positions before feeder F6. The data transfer from buffer shift register 148 to the shift registers in feeder controls 140 is clocked by a transfer clock 180 that produces an asymmetrical output at approximately 1 MHz. The output of transfer clock 180 is connected to an inverter 182 and to one input of an and gate 184. The output of inverter 182, signal T from transfer signal generator 146, and state 0 output 173 provide the inputs to a three-input and gate 186. The output of and gate 186 is connected via an or gate 188 to the stepping input 171 of state register 170. When signal T changes from logic zero to logic 1, calling for a data transfer, and state register 170 is in the zero state, and the output of inverter 182 is at logic 1, then and gate 186 will produce a logic 1 output which will be gated by or gate 188 to the step input of state register 170 to step the register from state 0 to state 1. Output 174 provides one input of a two input and gate 189 and provides the other input to and gate 184. Thus, when state register 170 steps from state 0 to state 1, and gate 186 is disabled and gate 184 is enabled. When and gate 184 is enabled, it passes clock pulses from transfer clock 180 via an or gate 190 and an and gate 191 to a binary counter 192, to the shift input of buffer shift register 148, and to each of the feeder controls 140. A 208 count detector 193 receives its input from the states of binary counter 192 and provides an output at 194 which provides an input to an inverter 195 and the second input to and gate 191. Output 194 remains at a logic 1 level until binary counter 192 reaches a count of 208, at which time output 194 changes to logic zero. this disables and gate 191 and terminates the flow of transfer clock pulses to binary counter 192, shift register 148, and feeder controls 140. Thus, the 208 bits of data in shift register 148 will have been transfered to one of the feeder controls 140.

When output 194 goes from logic 1 to logic zero, the output of inverter 195 goes from logic zero to logic 1. This output is connected to the reset terminal of binary counter 192, to the second input of and gate 189, and to one input of an and gate 196. Upon changing from logic zero to logic 1, the output of inverter 195 resets binary counter 192 to zero and, with state register 170 in state 1 causes a logic 1 output from and gate 189 to pass thru or gate 188 and advance state register 170 to state 2.

Output 175 of state register 170 provides one input to an and gate 198, the other input of which is provided by the output of an and gate 199. The three inputs to and gate 199 are provided by the outputs of comparators 163, 165, and 166. Thus, when state register 170 is in state 2, and gate 198 is enabled to pass the brief pulse from and gate 199 that occurs when the outputs of all three comparators are at logic 1. When state register 170 is in state 2, this pulse is passed via and gate 198 and an or gate 200 to one input of an and gate 201, the other input of which is provided by disc bit clock T9. The pulse from and gate 198 is also passed via or gate 188 to the stepping input 171 of state register 170 to advance state register 170 to state 3. This changes output 176 from logic zero to logic 1 which is passed by or gate 200 to and gate 201. Connecting both the output of and gate 198 and output 176 via or gate 200 to and gate 201 insures that and gate 201 will be enabled soon enough to pass the first required pulse from disc bit clock track T9 to counter 192 and shift register 148, which may occur before state register 170 changes from state 2 to state 3. Of course, when the change of state does occur, and gate 198 is disabled and output 176 will be at logic 1, maintaining and gate 201 enabled.

Binary counter 192 counts the pulses from disc bit clock T9 in the same manner that it counted pulses from transfer clock 180. Thus, when the count reaches 208, output 194 of count detector 193 goes from logic 1 to logic zero disabling and gate 191 and via inverter 195 resets binary counter 192. The output of inverter 195 also passes through and gate 196 which has been enabled by output 176 to reset state register 170 to state 0. When state register 170 is reset to zero, output 176 goes to logic zero, disabling and gate 201 and thereby preventing any further data transfer from the disc, even though on the next disc revolution the zone and sector addresses reappear. During states 2 and 3 when binary counter 192 and shift register 148 are receiving clock pulses from disc bit clock T9, shift register 148 is being loaded with the next required data from disc 36, the proper data track having been connected to its steering input by gating matrix 164 and the transfer having been initiated at the proper time by comparators 163, 165, and 166. Thus, shift register 148 is again holding the next data that will be required by the next feeder control 140.

FIG. 10 is a block diagram of the circuitry required for each feeder control 140 of system B. The proper transfer signal (T0-T35) from the signal generator 146 (FIG. 9) for the particular feeder control 140 is connected at 204 and provides one input to each of two 2-input and gates 205 and 206. The other input to and gate 205 is provided by transfer clock pulses from and gate 191. Therefore, when the transfer signal at 204 is at logic 1, and gate 205 is enabled and passes the transfer clock pulses via or gate 207 to shift register 208. Simultaneously, the transfer signal enables and gate 206 to pass knitting data from buffer shift register 148 via or gate 209 to the steering input of shift register 208. Thus, during the time that the transfer signal at 204 is at logic 1, transfer clock pulses are gated to the shift input and data from the buffer shift register is gated to the steering input of shift register 208 whereby the contents of shift register 148 are transfered to shift register 208. Because transfer clock 180 operates at approximately 1 MHz, this transfer requires approximately 0.2 milliseconds.

The transfer signal at 204 also provides the input for an inverter 211, the output of which provides one input to each of two and gates 213 and 214. The other input of and gate 213 is provided by the needle clock, which provides one pulse for each needle advance of the knitting machine cylinder. At all times when the transfer signal at 204 is at logic zero, and gate 213 is enabled and passes needle clock pulses via or gate 207 to the shift input of shift register 208. Simultaneously, and gate 214 is enabled to connect the output stage of shift register 208 via or gate 209 to the steering input of shift register 208. Thus, when the transfer signal at 204 is a logic zero, shift register 208 is stepped by the needle clock, and because its output stage is connected via and gate 214 and or gate 209 to its steering input, the data is repeatedly circulated through shift register 208.

The output of and gate 214 is also connected via line 87 to the steering inputs of steered flip flops FF0-FF12. It should be noted that the right hand portion of FIG. 10 is identical to and operates in the same manner as the right hand portion of FIG. 8 which has been described in connection with system A. Therefore, no further explanation of the right hand portion of FIG. 10 is required.

In the operation of system B, the encoder 33 leads the actual knitting process by 52 needles or one feeder count, plus a few needle positions, say five to allow for operating time of the actuators. In this manner, the disc address of the next data required is available to gating matrix 164 and comparators 163 and 165 as soon as the data in shift register 148 has been transferred to a feeder and state register 170 is stepped to state 0. By way of example, assume that the change point is five needles in front of feeder F35. At this time, buffer shift register 148 is holding the next data that will be required by feeder F35. Immediately after flip flop FF12 of feeder F35 has been steered by the 208th bit in shift register 208 for the ninth time, transfer signal T35 goes from logic zero to logic 1. Simultaneously, transfer pulse T initiates a data transfer from buffer shift register 148 to shift register 208 of feeder F35. At 30 revolutions per minute, one needle time on the illustrative knitting machine is approximately 1 millisecond. The data transfer from shift register 148 to shift register 208 requires only approximately 0.2 milliseconds. Therefore, the new data is loaded in shift register 208 and is available for use well in advance of the time it is needed.

As soon as the transfer from shift register 148 to shift register 208 of feeder F35 is complete, state register 170 is stepped to state 0 in readiness to effect the transfer of the next required data from disc 36. Signals T35 and T were generated by transfer signal generator 146 when the feeder count number changed from 35 to 0. Therefore, gating matrix 164 and comparators 163 and 165 are now presented with the disc address for the next data required by feeder F0. Feeder F0 at this time is operating on data in its shift register 208 for the ninth time. At 30 revolutions per minute, it will be over 50 milliseconds after shift register 208 of feeder 35 has been updated before shift register 208 of feeder F0 must be updated. This is far more time than the maximum required (16-⅔ milliseconds) to locate the data on disc 36 and transfer it to shift register 148.

It should be noted that it is not necessary for the pattern to be knitted an integral number of times around the cylinder. For example, assume the sectors were 256 bits long and shift registers 148 and 208 had 256 stages. This arrangement would provide for a pattern 256 stitches wide. Between times that each feeder shift register was updated, which is once every knitting machine revolution, the feeder would use the entire contents of the shift register seven times and would also use 80 of the 256 bits an eighth time. This shift register would then be updated, and the feeder would use the next data the same number of times. In fact, all feeders would be doing the same, which would result in the 256 stitch wide pattern being knitted 7 80/256 times around the finished tube.

In addition, it should be understood that although the invention has been described in conjunction with circular knitting machine in which the needle cylinder rotates relative to stationary feeders, it is contemplated that a known circular knitting machine in which the needle cylinder is stationary and the feeders rotate could be utilized. Also, it should be understood that although a rotatable memory disc 36 has been described in connection with the present invention, other memory devices could also be utilized.

Other variations and modifications of the knitting machine control of the present invention will become apparent upon reading and studying this specification and drawings, wherein the inventor has endeavored to describe this invention in such a full, clear, concise and exact terms as to enable any person skilled in the art to make and use the same, and has set forth the best mode presently contemplated of carrying out the invention.

Having described specific preferred embodiments of the invention, the following is claimed:

1. A machine for knitting any one of a plurality of different patterns, said machine including a rotatable needle cylinder holding a plurality of knitting needles, a plurality of feeders disposed about said needle cylinder for feeding strands of material to the needles during rotation of said needle cylinder, said feeders being disposed in feeder groups comprised of a number of feeders which is variable to correspond to a selected pattern, drive means for effecting relative rotation between said needle cylinder and feeders, actuator means in each of said feeders for effecting operation of said needles to knit the strands of material into stitch rows of a selected pattern on each revolution of relative rotation, data storage means for storing data corresponding to a selected one of a plurality of patterns, means for enabling the data in said data storage means to be changed from a first pattern which requires that each of the feeder groups include a first number of feeders and that a first number of revolutions of relative rotation occur between said needle cylinder and feeders to knit the first pattern to a second pattern which requires that each of the feeder groups include a second number of feeders which is different from said first number of feeders and that a second number of revolutions of relative rotation occur between said needle cylinder and feeders to knit the second pattern, reader means for reading data stored in said data storage means and for providing pattern signals which vary as a function of data stored in said data storage means, position indicator means operatively connected with said needle cylinder and feeders for providing position signals which vary upon relative rotation between said needle cylinder and feeders by said drive means and for providing a pattern repeat signal in response to a predetermined number of revolutions of relative rotation between said needle cylinder and feeders corresponding to the number of revolutions of relative rotation required to knit the selected one of the plurality of patterns, selector means for varying the predetermined number of revolutions of relative rotation which must occur between the needle cylinder and feeders before said position control means provides a pattern repeat signal, and pattern control means interconnecting said position indicator means, said reader means, and said actuator means for effecting operation of said actuator means in accordance with position signals and pattern repeat signals from said position indicator means and pattern signals from said reader means, said pattern control means including means for effecting a repeated reading of data in said data storage means and knitting of a pattern corresponding to this data upon relative rotation between said needle cylinder and feeders, register means for receiving pattern signals from said reader means, and means for effecting operation of said actuator means in a timed relationship with relative rotation between said needle cylinder and feeders and in accordance with pattern signals received by said register means from said reader means, said register means including first and second registers, said means for effecting operation of said actuator means includes gating means for effecting the transmission of pattern signals from said first register to said actuator means in response to one of said position signals from said position indicator means, and wherein said pattern control means further includes means for effecting the transmission of pattern signals from said reader means to said second register contemporaneously with the transmission of pattern signals from said first register to said actuator means.

2. A machine as set forth in claim 1 wherein said data storage means includes means for defining a plurality of data storage locations at which data for one of said patterns is stored, said pattern control means including means for associating each of said feeders with data storage locations during the knitting of any one of said plurality of patterns to enable operation of any one of said feeders to be varied from one pattern to another by varying the pattern data at the data storage locations associated with the feeder.

3. A machine as set forth in claim 1 wherein said gating means includes means for effecting the transmission of pattern signals from said second register to said actuator means in response to one of said position signals from said position indicator means, and wherein said pattern control means further includes means for effecting the transmission of pattern signals from said reader means to said first register contemporaneously with the transmission of pattern signals from said second register to said actuator means.

4. A machine as set forth in claim 1 wherein said pattern control means further includes means for effecting the transmission of pattern signals from said second register to said first register.

5. A machine as set forth in claim 1 wherein said reader means includes means for reading the data stored in said data storage means at a rate which is substantially greater than the rate at which said knitting machine is operable to knit a pattern corresponding to the data in said data storage means.

6. A knitting machine as set forth in claim 1 wherein said position indicator means includes encoder means connected with said needle cylinder for providing digital position signals which vary with variations in the rotational position of said needle cylinder, said pattern control means including translator means connected with said encoder means for receiving digital position signals from said encoder means and providing output signals which vary with variations in the digital position signals.

7. A knitting machine as set forth in claim 1 further including drive means for effecting relative rotation between said needle cylinder and feeders, and wherein said memory means includes means for enabling the digital pattern data at the memory locations to be changed from data corresponding to a first pattern which is knitted during a first number of revolutions of relative rotation between said needle cylinder and feeders to data corresponding to a second pattern which is knitted during a second number of revolutions of relative rotation between said needle cylinder and feeders and which is different from said first number of revolutions, and wherein said means for generating data address signals includes means for sequentially repeating a first series of data address signals each time the first number of revolutions of relative rotation occurs between said needle cylinder and feeders during a knitting of the first pattern and for sequentially repeating a second series of data address signals each time the second number of revolutions of relative rotation occurs between said needle cylinder and feeders during a knitting of the second pattern.

8. Knitting machine control apparatus for use in a knitting machine having a plurality of actuators for effecting operation of needles disposed on a needle cylinder to knit a predetermined pattern, said knitting machine control apparatus comprising data storage means for storing a plurality of groups of pattern data each of which relates to a portion of the predetermined pattern and has a unique address, reader means for reading said groups of data, first indicator means for indicating the address of data currently being read by said reader means, second indicator means operatively connected with the knitting machine for indicating the address of a group of pattern data required for knitting a portion of the pattern, and control means for detecting when the address of a group of data to be read by said reader means corresponds to the address of the group of pattern data indicated by said second indicator means as being required for knitting a portion of the pattern and for effecting activation of at least some of said actuators in accordance with the data contained in this group of data, said control means including comparator means for comparing the address of a group of data to be read by said reader means with the address of the group of data indicated by said second indicator means as being required for knitting a portion of the pattern, register means for receiving data signals from said reader means when said comparator means detects that the address of a group data being read by said reader means matches the address of the group of data indicated by said second indicator means as being required for knitting a portion of the pattern, and means for effecting sequential operation of a plurality of said actuators in a timed relationship with rotation of the needle cylinder and in accordance with data signals received from said register means, said register means includes first and second registers each of which is capable of storing one of the groups of pattern data, and gating means for effecting the transmission of a group data from reader means to one of said registers and for contemporaneously therewith effecting the transmission of a group of data from the other of said registers to said means for effecting sequential operation of a plurality of said actuators.

9. Knitting machine control apparatus as set forth in claim 8 further including a plurality of feeders for feeding strands of material to the needles and drive means for effecting relative rotation between said needle cylinder and feeders, said control means including pulse generator means for generating a control pulse each time relative movement occurs between the needle cylinder and feeders for a distance corresponding to one needle position, said means for effecting sequential operation of said actuators including second gating means connected with said pulse generator means for transmitting a pattern signal to each of said plurality of actuators in turn upon receipt of a control pulse from said pulse generator means.

10. Knitting machine controls as set forth in claim 8 further including a plurality of feeders and drive means for effecting relative rotation between said feeders and needle cylinder, and wherein an address indicated by said second indicator means includes a component which varies as a function of the number of revolutions of relative rotation between said needle cylinder and feeders from an initial position during the knitting of a pattern and wherein said control means includes means for effecting an activation of some of said actuators in accordance with a group of data having an address corresponding to the revolution indicated by an address provided by said second indicator means and for effecting activation of some of said actuators in accordance with a group of data having an address corresponding to a revolution other than the revolution indicated by the address corresponding to a revolution other than the revolution indicated by the address provided by said second indicator means.

11. A knitting machine as set forth in claim 8 wherein said second indicator means includes means for providing data address signals each of which has a component which varies as a function of the number of stitch rows which are knitted during the knitting of a pattern and wherein said groups of pattern data in said data storage means have addresses which include a component which is determined by the stitch row during which the data in the groups of data is to be utilized.

12. A knitting machine as set forth in claim 8 further including drive means for effecting rotation of said needle cylinder, and wherein said data storage means includes means for enabling the pattern data in said groups of pattern data to be changed from data corresponding to a first pattern which is knitted during a first number of revolutions of said needle cylinder to data corresponding to a second pattern which is knitted during a second number of revolutions of said needle cylinder and which is different from said first number of revolutions, and wherein said second indicator means includes means for sequentially repeating a first series of data address signals each time the first number of revolutions of needle cylinder rotation occurs during a knitting of the first pattern and for sequentially repeating a second series of data address signals each time the second number of revolutions of needle cylinder rotation occurs during a knitting of the second pattern.

* * * * *